US005777548A

United States Patent [19]

Murakami et al.

[11] Patent Number: 5,777,548

[45] Date of Patent: Jul. 7, 1998

[54] FIRE MONITORING APPARATUS AND COMPUTER READABLE MEDIUM RECORDED WITH FIRE MONITORING PROGRAM

[75] Inventors: Yoshishige Murakami; Kanji Hirota; Yoshiharu Kanzaki, all of Kawasaki, Japan

[73] Assignee: Fujitsu Limited, Kanagawa, Japan

[21] Appl. No.: 891,899

[22] Filed: Jul. 14, 1997

[30] Foreign Application Priority Data

Dec. 12, 1996 [JP] Japan ..... 8-332307

[51] Int. Cl.[6] ..... G08B 29/00

[52] U.S. Cl. ..... 340/506; 340/578; 250/554

[58] Field of Search ..... 340/506, 511, 340/517, 521, 524, 578, 600; 250/554, 339.04, 339.15

[56] References Cited

U.S. PATENT DOCUMENTS 5,486,811 1/1996 Wehrle et al. ..... 340/522

5,510,772 4/1996 Lasenby ..... 340/578

5,547,369 8/1996 Sohma et al. ..... 431/75

*Primary Examiner*—Jeffery A. Hofsass

*Assistant Examiner*—Daryl C. Pope

*Attorney, Agent, or Firm*—Helfgott & Karas, P.C.

[57] ABSTRACT

A monitoring target plane is photographed with infrared-rays by each infrared-ray camera. A converter converts format of image data from each infrared-ray camera from analog format into digital format. A control unit, when detecting an abnormal area consisting of pixels having a density value over a fixed value in the image data, calculates an azimuth and an angle of elevation toward the sun from an abnormal location on the monitoring target plane that corresponds to that abnormal area, and judges that a fire occurs if an azimuth toward the abnormal location from the infrared-ray camera photographing the image data including the abnormal area is not coincident with the calculated azimuth toward the sun, or if an angle of depression toward the abnormal location from this infrared-ray camera is not coincident with the calculated angle of elevation toward the sun.

10 Claims, 17 Drawing Sheets

FIRE MONITORING APPARATUS AND COMPUTER READABLE MEDIUM RECORDED WITH FIRE MONITORING PROGRAM

BACKGROUND OF THE INVENTION

1. Field of the Invention

The present invention relates to a fire monitoring apparatus utilizing an infrared-ray camera and to a computer readable medium recorded with a program.

2. Description of the Related Art

A fire monitoring apparatus including infrared-ray cameras have hitherto been used as an apparatus for monitoring a fire in a large closed space (atrium, etc.) inwardly of a building and in an extensive place such as an outdoor athletic field, etc.. This type of conventional fire monitoring apparatus will be explained with reference to FIGS. 16 and 17.

Referring to FIG. 16, a fire monitoring apparatus 50 comprises a keyboard 51, a display device 52, an infrared-ray camera 53 and a computer 60. This computer 60 is constructed of a keyboard interface 61, a display device interface 62, and AD converter 63, a storage device interface 65, a memory 66 and a control unit 67 that are connected to each other via a bus B3, and a storage device 64 connected via the storage device interface 65 to the bus B3.

The keyboard 51 is a device through which an operator inputs data such as characters and so on, and is connected via the keyboard interface 61 to the bus B3.

The infrared-ray camera 53 takes a high angle shot of a monitoring target plane with infrared rays, and inputs image data obtained by the photographing to the AD converter 63. This infrared-ray camera 53 is disposed on periphery of the monitoring target plane and is adjusted so that image field of the camera 53 covers the monitoring target plane.

The display device 52 displays images taken by the infrared-ray camera 53 and the characters, etc. inputted through the keyboard 51.

The computer 60 processes the image data transmitted from the infrared-ray camera 53, and makes the display device 52 display the images of the monitoring target plane. The computer 60 then judges whether or not a fire occurs within the monitoring target plane on the basis of this item of image data. The keyboard interface 61 is a device for transmitting input data from the keyboard 51 to the bus B3. The display device interface 62 is a device for getting the display device 52 to display the characters, the images and so on. The AD (Analog-to-Digital) converter 63 converts a format of the image data inputted by the infrared-ray camera 53 into digital format of a grey scale, and transmits the image data of the digital format to the bus B3. The storage device 64 is a hard disk for storing a control processing program executed by the control unit 67. The storage device interface 65 is a device for writing and reading the data to and from the storage device 64. The memory 66 is constructed of a RAM (Random Access Memory), etc. and used for operations by the control unit 67. The control unit 67 is constructed of a CPU (Central Processing Unit), etc. gives a screen display instruction to the display device interface 62, and gives a data write or read instruction to the storage device interface 65. The control unit 67 receives the input data from the keyboard interface 61 and the image data from the AD converter 63, respectively. The control unit 67 executes a process for the input data inputted from the keyboard 51, a process of generating the image data to be displayed on the display device 52, and a process for the image data inputted from the AD converter 63.

Next, operations of the thus constructed fire monitoring apparatus 50 will be explained with reference to a flowchart of FIG. 17. The flowchart of FIG. 17 shows the control processing program in the fire monitoring apparatus 50. The control unit 67 of the fire monitoring apparatus 50 executes the control processing program at a fixed time interval.

In first step S301 after starting this fire monitoring program, the control unit 67 receives the image data given from the infrared-ray camera 53 through the AD converter 63.

In next step S302, the control unit 67 checks whether or not a high-temperature part exists in the image data. If the high-temperature part exists, the processing moves to step S303. Whereas if not, the processing comes to an end.

In step S303, the control unit 67 instructs the display device interface 62 so that the display device 52 displays character information indicating occurrence of a fire and positional data of the fire occurrence location. Simultaneously with this process, the control unit 67 instructs the storage device interface 65 to write the fact that the fire occurs and the positional data of the fire occurrence location into the storage device 64.

The prior art fire monitoring apparatus 50 judges whether or not the fire happens through the processes described above. If there is a puddle or a metal plate within the monitoring target plane, however, the sun light might be reflected therefrom and be incident upon the infrared-ray camera 53. The sun light contains a large quantity of infrared-rays, and therefore, in such a case, spots where the sun light is reflected by the puddle or the metal plate are equalized to the high-temperature part. Accordingly, the control processing program described above is incapable of distinguishing the sun light reflecting spots from a spot where the fire actually occurs.

SUMMARY OF THE INVENTION

It is a first object of the present invention to provide a fire monitoring apparatus capable of minimizing a possibility of such a mis-recognition that a fire occurs when the sun light reflected by a puddle, etc. is incident upon an infrared-ray camera.

It is a second object of the present invention to provide a fire monitoring apparatus capable of minimizing such a mis-recognition that the sun light is incident on the infrared-ray camera when the infrared-rays caused by the fire strike in the infrared-ray camera.

According to a first aspect of the present invention, to accomplish the first object, a fire monitoring apparatus comprises an infrared-ray photographing device for photographing a monitoring target plane with infrared-rays, a detecting device for detecting an abnormal area exhibiting a temperature over a fixed temperature, in an infrared-ray image photographed by the infrared-ray photographing device, a calculating device for calculating an azimuth and an angle of elevation toward the sun from an abnormal location on the monitoring target plane which corresponds to the abnormal area, and a comparing device for comparing an azimuth toward the abnormal location from the infrared-ray photographing device with an azimuth toward the sun from the abnormal location, and for comparing an angle of depression toward the abnormal location from the infrared-ray photographing device with the angle of elevation toward the sun from the abnormal location, and a judging device for judging that fire occurs if any one of these comparisons does not result in coincident.

According to the first aspect of the present invention, the infrared-ray photographing device photographs the infrared-ray image of the monitoring target plane. Next, the detecting device detects the abnormal area exhibiting the temperature over the fixed temperature from the infrared-ray image photographed by the infrared-ray photographing device. Subsequently, the calculating device calculates the azimuth and the angle of elevation toward the sun from the abnormal location in the same plane which corresponds to the abnormal area. Next, the comparing device compares the azimuth toward the abnormal location from the infrared-ray photographing device with the azimuth toward the sun from the abnormal location. The comparing device also compares the angle of depression toward the abnormal location from the infrared-ray photographing device with the angle of elevation toward the sun from the abnormal location. Then, the judging device judges that the fire happens if any one of the comparisons does not result in coincident.

Thus, if there is the area exhibiting the temperature over the fixed temperature in the infrared-ray image photographed by the infrared-ray photographing device, and if the azimuth toward the abnormal location from the infrared-ray photographing device is not coincident with the azimuth toward the sun from the abnormal location, or if the angle of depression toward the abnormal location from the infrared-ray photographing device is not coincident with the angle of elevation toward the sun from the abnormal location, the judging device judges that the fire occurs. Hence, there must be no possibility of making such a mis-recognition that the fire occurs due to the reflected light of the sun light despite of the fact that no fire happens.

According to a second aspect of the present invention, to accomplish the second object as well as accomplishing the first object, a fire monitoring apparatus comprises a plurality of infrared-ray photographing devices arranged so that each area within a monitoring target plane is photographed with infrared-rays by at least two infrared-ray device in different directions, a detecting device for detecting an abnormal area exhibiting a temperature over a fixed temperature in infrared-ray images photographed by each of the infrared-ray photographing devices, a calculating device for calculating an azimuth and an elevation angle toward the sun from an abnormal location on the monitoring target plane which corresponds to the abnormal area, and a comparing device for comparing an azimuth toward the abnormal location from the infrared-ray photographing device that photographs an infrared-ray image containing the abnormal area with an azimuth toward the sun from the abnormal location and for comparing an angle of depression toward the abnormal location from the infrared-ray photographing device with the angle of elevation toward the sun from the abnormal location, and a judging device for judging, if any one of these comparisons does not result in coincident, that fire occurs.

According to the second aspect of the present invention, each of the areas within the monitoring target plane is photographed by the plurality of infrared-ray photographing devices. The detecting device detects the abnormal area exhibiting the temperature over the fixed temperature in the infrared-ray images photographed by the respective infrared-ray photographing devices. Next, the calculating device calculates the azimuth and the angle of elevation toward the sun from the abnormal location on the monitoring target plane which corresponds to the detected abnormal area. Next, the comparing device compares the azimuth toward the abnormal location from the infrared-ray photographing device photographing the infrared-rays containing the abnormal area with the azimuth toward the sun from the abnormal location. The control device also compares the angle of depression toward the abnormal location from the infrared-ray photographing device with the angle of elevation toward the sun from the abnormal location. Then, the judging device judges that the fire occurs if any one of the comparison does not result in coincident.

Thus, if there is the area exhibiting the temperature over the fixed temperature in the infrared-ray images photographed by any infrared-ray photographing device, and if the azimuth toward the abnormal location from the infrared-ray photographing device is not coincident with the azimuth toward the sun from the abnormal location, or if the angle of depression toward the abnormal location from the infrared-ray photographing device is not coincident with the angle of elevation toward the sun from the abnormal location, the judging device judges that the fire occurs. Hence, there must be no possibility of making such a mis-recognition that the fire occurs due to the reflected light of the sun light despite of the fact that no fire happens. Further, every spot on the monitoring target plane is photographed in a plurality of directions, and hence there must be no possibility of such a mis-recognition that the fire does not occur and the abnormal area is due to the reflected light of the sun light in spite of the fact that the fire happens.

According to a third aspect of the present invention, to accomplish the second object as well as accomplishing the first object, a fire monitoring apparatus comprises a plurality of fixed infrared-ray photographing devices for photographing one of partial areas on a monitoring target plane with infrared-rays, a confirmation infrared-ray photographing device capable of photographing all areas on the monitoring target plane with infrared-rays by rotating a photographic optical axis thereof, a rotating device for rotating the photographic optical axis of the confirmation infrared-ray photographing device, a detecting device for detecting an abnormal area exhibiting a temperature over a fixed temperature in infrared-ray images photographed by the fixed infrared-ray photographing devices and infrared-ray image photographed by the confirmation infrared-ray photographing device, a calculating device for calculating an azimuth and an angle of elevation toward the sun from an abnormal location on the monitoring target plane which corresponds to the abnormal area detected in the infrared-ray image photographed by any of the fixed infrared-ray photographing devices, and a comparing device for comparing an azimuth toward the abnormal location from the fixed infrared-ray photographing device with an azimuth toward the sun from the abnormal location and for comparing an angle of depression toward the abnormal location from the fixed infrared-ray photographing device with the angle of elevation toward the sun from the abnormal location, and a control device for judging, if any one of these comparisons does not result in coincident, that fire occurs, and, if either comparison is coincident, instructing the rotating device to rotate the photographic axis of the confirmation infrared-ray photographing device so that an image field of the confirmation infrared-ray photographing device includes the abnormal location, and thereafter judging that the fire occurs in case an abnormal area corresponding to the abnormal location is contained in the infrared-ray image photographed by the confirmation infrared-ray photographing device.

According to the third aspect of the present invention, each area within the monitoring target plane is photographed by the plurality of fixed infrared-ray photographing devices. Further, the confirmation infrared-ray photographing device is capable of photographing the entire monitoring target plane with the infrared-rays by the photographic optical axis being rotated by the rotating device. The detecting device detects the abnormal area exhibiting the temperature over the fixed temperature in the infrared-ray images photographed by the respective fixed infrared-ray photographing devices and the infrared-ray image photographed by the confirmation infrared-ray photographing device. The calculating device calculates the azimuth and the angle of elevation toward the sun from the abnormal location on the monitoring target plane which corresponds to the abnormal area if the abnormal area is contained in an infrared-ray image photographed by any one of the fixed infrared-ray photographing devices. The comparing device compares the azimuth toward the abnormal location from this fixed infrared-ray photographing device with the azimuth toward the sun from the abnormal location. The comparing device also compares the angle of depression toward the abnormal location from the fixed infrared-ray photographing device with the angle of elevation toward the sun from the abnormal location. Then, the control device judges that the fire occurs if the any one of the comparison does not result in coincident. Contrastingly, if both of the comparison result in coincident, the control device instructs the rotating device to rotate the photographic axis of the confirmation infrared-ray photographing device so that the abnormal location falls within the image field of the confirmation infrared-ray photographing device. Then, the control device judges that the fire occurs if an abnormal area corresponding to the abnormal location is contained in the infrared-ray images photographed by the confirmation infrared-ray photographing device.

Thus, if there is the area exhibiting the temperature over the fixed temperature in an infrared-ray image photographed by one of the fixed infrared-ray photographing devices, and if the azimuth toward the abnormal location from the infrared-ray photographing device is not coincident with the azimuth toward the sun from the abnormal location, or if the angle of depression toward the abnormal location from the infrared-ray photographing device is not coincident with the angle of elevation toward the sun from the abnormal location, the control device judges that the fire occurs. Hence, there must be no possibility of making such a mis-recognition that the fire occurs due to the reflected light of the sun light despite of the fact that no fire happens. Furthermore, even if the azimuth toward the abnormal location from the infrared-ray photographing device is coincident with the azimuth toward the sun from the abnormal location, and even if the angle of depression toward the abnormal location from the infrared-ray photographing device is coincident with the angle of elevation of toward the sun from the abnormal location, it is judged that the fire occurs on condition that there is the abnormal area corresponding to the abnormal location is contained in the infrared-ray images photographed by the confirmation infrared-ray photographing device. Hence, there is no possibility of such a mis-recognition that the fire does not happen and the abnormal area is due to the incidence of the reflected light of the sun light despite the fact that the fire occurs.

According to a fourth aspect of the present invention, to accomplish the first object, a fire monitoring apparatus comprises an infrared-ray photographing device for photographing a monitoring target plane with infrared-rays, a detecting device for detecting an abnormal area exhibiting a temperature over a fixed temperature in an infrared-ray image photographed by the infrared-ray photographing device, a storing device for storing segmenting data for segmenting the monitoring target plane into small regions and univocally allocating numerals to the respective small regions, and a sun reflection table in which the numerals are made corresponding to a date and a time zone when an azimuth toward each small region from the infrared-ray photographing device is coincident with an azimuth toward the sun from the same small region for every small region and an angle of depression toward the same small region from the infrared-ray photographing device is coincident with an angle of elevation toward the sun from the small region, and a control device for obtaining the numeral allocated to the small region which includes an abnormal location, corresponding to the abnormal area, on the monitoring target plane on the basis of the segmenting data, reading the date and the time zone made corresponding to that numeral from the sun reflection table, and judging that fire occurs if a data and a time when the infrared-ray image is photographed are not included in the date and the time zone read from the sun reflection table.

According to the fourth aspect of the present invention, the monitoring target plane is photographed with the infrared-rays by the infrared-ray photographing device. The detecting device detects the abnormal area exhibiting the temperature over the fixed temperature in the infrared-ray image photographed by the infrared-ray photographing device. The storing device is stored with segmenting data for segmenting the monitoring target plane into the small regions and univocally allocating the numerals to the respective small regions, and the sun reflection table in which the numerals are made corresponding to the date and the time zone when an azimuth toward each small region from the infrared-ray photographing device is coincident with the azimuth toward the sun from the same small region for every small region and an angle of depression toward the same small region from the infrared-ray photographing device is coincident with the angle of elevation of the small region. The control device specifies the numeral allocated to the small region which includes the abnormal area, and reads the date and the time zone made corresponding to that numeral from the sun reflection table. Then, the control device judges that the fire occurs if the date and the time when the infrared-ray image is photographed are not included in the date and the time zone.

Thus, if there is the area exhibiting the temperature over the fixed temperature in the infrared-ray images photographed by the infrared-ray photographing device, it is judged that the fire occurs in a case where the date and the time when the relevant infrared-ray image is photographed are not included in a date and a time zone. Without such a possibility that the reflected light of the sun light might be incident upon the infrared-ray photographing device. Hence, there is no possibility of such a mis-recognition that the fire happens due to the reflected light of the sun light in spite of the fact that no fire happens.

According to a fifth aspect of the present invention, to accomplish the second object as well as accomplishing the first object, a fire monitoring apparatus comprises a plurality of fixed infrared-ray photographing devices for respectively photographing any one of partial areas on a monitoring target plane with infrared-rays, a confirmation infrared-ray photographing device capable of photographing all areas on the monitoring target plane with infrared-rays by rotating a photographic optical axis thereof, a rotating device for rotating the photographic optical axis of the confirmation infrared-ray photographing device, a detecting device for detecting an abnormal area exhibiting a temperature over a fixed temperature in infrared-ray images photographed by the respective fixed infrared-ray photographing devices and an infrared-ray image photographed by the confirmation infrared-ray photographing device, a storing device for storing segmenting data for segmenting the monitoring target plane into small regions and univocally allocating numerals to the respective small regions, and a sun reflection table in which the numerals are made corresponding to a date and a time zone when an azimuth toward each small region from a fixed infrared-ray photographing device is coincident with an azimuth toward the sun from the same small region and an angle of depression of toward the same small region from the same fixed infrared-ray photographing device is coincident with an angle of elevation toward the sun from the same small region for every small region, and a control device for specifying the numeral allocated to the small region which includes an abnormal location on the monitoring target plane that corresponds to the abnormal area detected in the infrared-ray image photographed by any one of the fixed infrared-ray photographing devices on the basis of the segmenting data, reading a date and a time zone made corresponding to the specified numeral from the sun reflection table, judging that fire occurs if a date and a time when the infrared-ray image is photographed are not included in the date and the time zone read from the sun reflection table, instructing the rotating device to rotate the photographic optical axis of the confirmation infrared-ray photographing device so that the small region is included in an image field of the confirmation infrared-ray photographing device if the date and the time when the infrared-ray image is photographed are included in the date and the time zone read from the sun reflection table, and judging that the fire occurs if an abnormal area corresponding to the abnormal location is contained in the infrared-ray image photographed by the confirmation infrared-ray photographing device.

According to the fifth aspect of the present invention, each area within the monitoring target plane is photographed by the plurality of fixed infrared-ray photographing devices. Further, the confirmation infrared-ray photographing device is capable of photographing the entire areas on the monitoring target plane by the rotating its photographic optical axis. The detecting device detects the abnormal area exhibiting the temperature over the fixed temperature from the infrared-ray images photographed by the respective fixed infrared-ray photographing devices and the infrared-ray image photographed by the confirmation infrared-ray photographing device. The storing device is stored with the segmenting data for segmenting the monitoring target plane into the small regions and univocally allocating numerals to the respective small regions, and a sun reflection table in which the numerals are made corresponding to the date and the time zone when the azimuth toward each small region from a fixed infrared-ray photographing device is coincident with the azimuth toward the sun from the same small region and the angle of depression toward the same small region from the same fixed infrared-ray photographing device is coincident with the angle of elevation toward the sun from the small region for every small region. The control device specifies the numeral allocated to the small region to which includes the abnormal area on the basis of the segmenting data, and reads the date and the time zone made corresponding to that numeral from the sun reflection table. Then, the control device judges that the fire occurs if the date and the time when the above infrared-ray image is photographed are not included in the date and the time zone read from the table. Whereas if the date and the time when the infrared-ray image is photographed are included in the date and the time zone read from the table, the control device instructs the rotating device to rotate the photographic axis of the confirmation infrared-ray photographing device so that the abnormal location is included in the image field of the confirmation infrared-ray photographing device. Then, if the abnormal area corresponding to the abnormal location is contained in the infrared-ray image photographed by the confirmation infrared-ray photographing device, it is judged that the fire occurs.

Thus, if there is the area exhibiting the temperature over the fixed temperature in an infrared-ray image photographed by any fixed infrared-ray photographing device, it is judged that the fire occurs in a case where the date and the time when the infrared-ray image is photographed are not included in the date and the time zone without such a possibility that the reflected light of the sun light might be incident upon the infrared-ray photographing device. Hence, there is no possibility of such a mis-recognition that the fire happens due to the reflected light of the sun light in spite of the fact that the fire occurs. Moreover, even if the date and the time when the infrared-ray image is photographed are included in the date and the time zone with such a possibility that the reflected light of the sun light might be incident upon the infrared-ray photographing device, it is judged that the fire occurs on condition that there is an abnormal area exhibiting the temperature over the fixed temperature in the infrared-ray image photographed by the confirmation infrared-ray photographing device. Hence, there is no possibility of such a mis-recognition that the fire does not occur and the abnormal area is due to the reflected light of the sun light in spite of the fact that the fire occurs.

According to a sixth aspect of the present invention, to accomplish the first object, there is provided a computer readable medium recorded with a program of instructing a computer connected to an infrared-ray photographing device for photographing a monitoring target plane with infrared-rays, to execute processes of detecting an abnormal area exhibiting a temperature over a fixed temperature from infrared-ray images photographed by the infrared-ray photographing device, calculating an azimuth and an angle of elevation toward the sun from an abnormal location on the monitoring target plane which corresponds to the abnormal area, comparing an azimuth toward the abnormal location from the infrared-ray photographing device with an azimuth toward the sun from the abnormal location, also comparing an angle of depression toward the abnormal location from the infrared-ray photographing device with the angle of elevation toward the sun from the abnormal location up, and judging that fire occurs if any one of the comparisons does not result in coincident.

According to a seventh aspect of the present invention, to accomplish the second object as well as accomplishing the first object, there is provided a computer readable medium recorded with a program of instructing a computer connected to a plurality of infrared-ray photographing devices arranged so that each area within a monitoring target plane is photographed with infrared-rays by at least infrared-ray photographing devices in different directions to execute processes of detecting an abnormal area exhibiting a temperature over a fixed temperature in infrared-ray images photographed by the infrared-ray photographing devices, calculating an azimuth and an angle of elevation toward the sun from an abnormal location on the monitoring target plane which corresponds to the abnormal area, comparing an azimuth toward the abnormal location from the infrared-ray photographing device photographing infrared-ray images containing the abnormal area with an azimuth toward the sun from the abnormal location, also comparing an angle of depression toward the abnormal location from the infrared-ray photographing device with the angle of elevation toward the sun from the abnormal location, and judging that fire occurs if any one of the comparisons does not result in coincident.

According to an eighth aspect of the present invention, to accomplish the second object as well as accomplishing the first object, there is provided a computer readable medium recorded with a program of instructing a computer connected to a plurality of fixed infrared-ray photographing devices for respectively photographing any one of partial areas on a monitoring target plane with infrared-rays, a confirmation infrared-ray photographing device capable of photographing the entire areas on the monitoring target plane with the infrared-rays by rotating a photographic optical axis thereof, and a rotating device for rotating the photographic optical axis of said confirmation infrared-ray photographing device, to execute processes of detecting an abnormal area exhibiting a temperature over a fixed temperature in infrared-ray images photographed by the fixed type infrared-ray photographing devices and an infrared-ray image photographed by the confirmation infrared-ray photographing device, calculating an azimuth and an angle of elevation toward the sun from an abnormal location on the monitoring target plane which corresponds to the abnormal area detected in the infrared-ray image photographed by any of the fixed infrared-ray photographing devices, comparing an azimuth toward the abnormal location from the fixed infrared-ray photographing device with an azimuth toward the sun from the abnormal location, also comparing an angle of depression toward the abnormal location from the fixed infrared-ray photographing device with the angle of elevation toward the sun from the abnormal location, judging that a fire occurs if any one of the comparisons does not result in coincident, and instructing the rotating device to rotate the photographic optical axis of the confirmation infrared-ray photographing device so that an image field of the confirmation infrared-ray photographing device includes the abnormal location, if both of those comparison is coincident, and thereafter judging that fire occurs in case an abnormal area corresponding to the abnormal location is contained in the infrared-ray image photographed by the confirmation infrared-ray photographing device.

According to a ninth aspect of the present invention, to accomplish the first object, there is provided a computer readable medium recorded with a program of instructing a computer connected to an infrared-ray photographing device for photographing a monitoring target plane, and comprising a storage device which stores segmenting data for segmenting the monitoring target plane into small regions and for univocally allocating numerals to the respective small regions and a sun reflection table in which the numerals are made corresponding to a date and a time zone when an azimuth toward each small region from the fixed infrared-ray photographing devices is coincident with an azimuth toward the sun from this small region and an angle of depression toward the same small region from the fixed infrared-ray photographing device is coincident with an angle of elevation toward the sun from the small region for every small region, to execute processes of detecting an abnormal area exhibiting a temperature over a fixed temperature in an infrared-ray image photographed by the infrared-ray photographing device, specifying the numeral allocated to a small region which includes an abnormal location on the monitoring target plane that corresponds to the abnormal area on the basis of the segmenting data, reading a date and a time zone made corresponding to the specified numeral from the sun reflection table, and judging that fire occurs if the date and the time when the infrared-ray image is photographed are not included in the date and the time zone read from the sun reflection table.

According to a tenth aspect of the present invention, to accomplish the second object as well as accomplishing the first object, there is provided a computer readable medium recorded with a program of instructing a computer connected to a plurality of fixed infrared-ray photographing devices for respectively photographing any one of partial areas on a monitoring target plane with infrared-rays, a confirmation infrared-ray photographing device capable of photographing the entire areas on the monitoring target plane with the infrared-rays by rotating a photographic optical axis thereof, and a rotating device for rotating the photographic optical axis of the confirmation infrared-ray photographing device, and comprising a storage device which stores segmenting data for segmenting the monitoring target plane into small regions and for univocally allocating numerals to the respective small regions, and a sun reflection table in which the numerals are made corresponding to a date and a time zone when an azimuth toward each small region from a fixed infrared-ray photographing devices is coincident with an azimuth toward the sun from the same small region and an angle of depression toward the same small region from the same fixed infrared-ray photographing device is coincident with an angle of elevation toward the sun from the same small region for every small region, to execute processes of detecting an abnormal area exhibiting a temperature over a fixed temperature in an infrared-ray images photographed by the respective fixed infrared-ray photographing devices and an infrared-ray image photographed by the confirmation infrared-ray photographing device, specifying the numeral allocated to a small region which includes an abnormal location on the monitoring target plane that corresponds to the abnormal area detected in the infrared-ray image photographed by any one of the fixed infrared-ray photographing device on the basis of the segmenting data, reading a date and a time zone made corresponding to the specified numeral from the sun reflection table, judging that fire occurs if the date and the time when the infrared-ray images are photographed are not included in the date and the time zone read from the sun reflection table, instructing, if the date and the time when the infrared-ray images are photographed are included in the date and the time zone read from the sun reflection table, the rotating device so that the small region is embraced into an image field of the confirmation infrared-ray photographing device, and judging that fire occurs if an abnormal area corresponding to the abnormal location is contained in the infrared-ray image photographed by the confirmation infrared-ray photographing device.

BRIEF DESCRIPTION OF THE DRAWINGS

The invention will be described below in detail with reference to the accompanying drawings, in which.

DESCRIPTION OF THE PREFERRED EMBODIMENTS

Embodiments of the present invention will hereinafter be described with reference to the drawings.

FIRST EMBODIMENT

Figure 1:
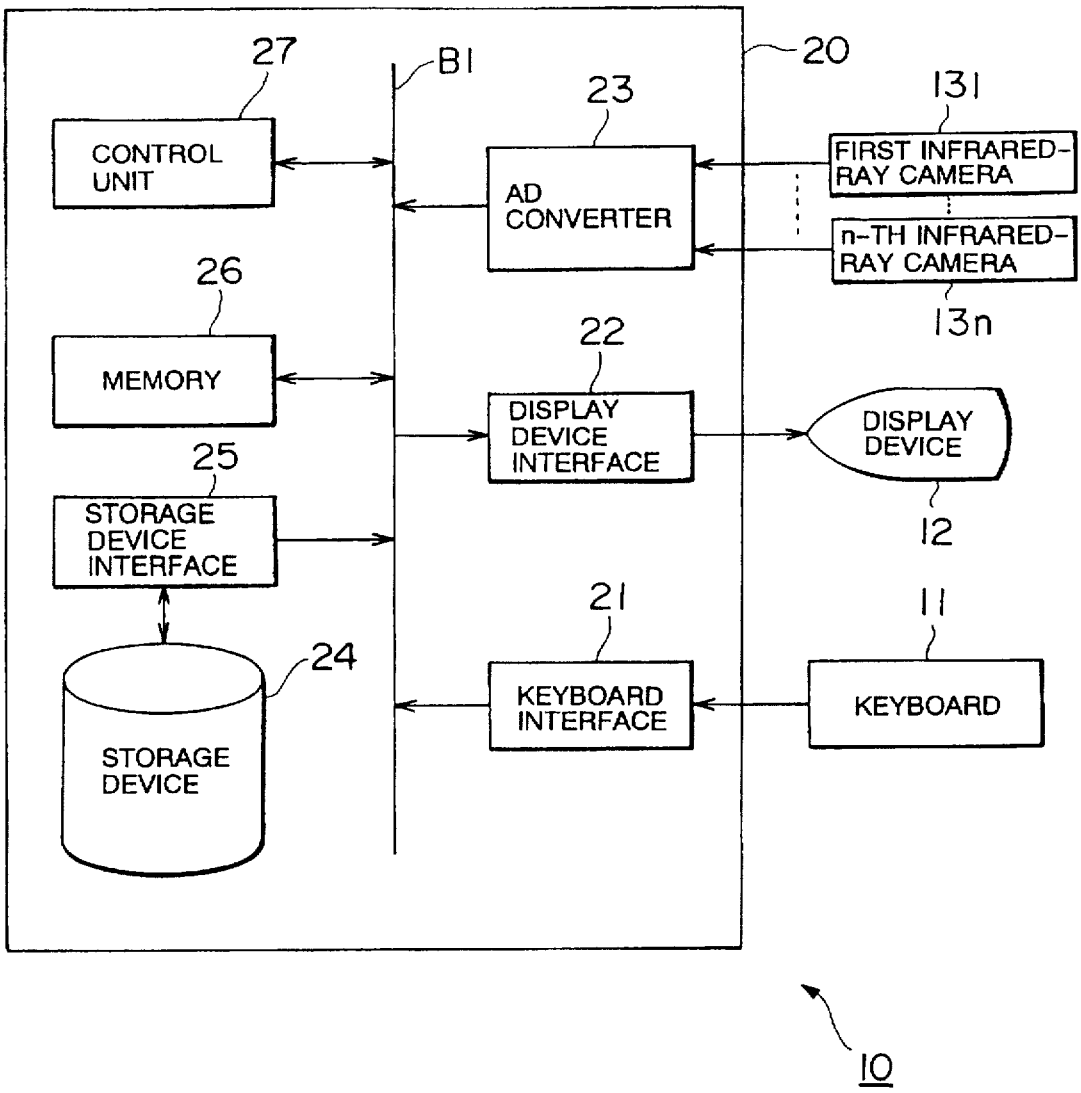
FIG. 1 is a block diagram illustrating a construction of a fire monitoring apparatus in a first embodiment of the present invention.

FIG. 1 is a block diagram illustrating a construction of a fire monitoring apparatus 10 in a first embodiment of the present invention. Referring to FIG. 1, the fire monitoring apparatus 10 is constructed of a keyboard 11, a display device 12, n-sets of infrared-ray cameras **13*l*–13*n*, and a computer 20. This computer 20 is constructed of a keyboard interface 21, a display device interface 22, an AD converter 23, a storage device interface 25, a memory 26, a control unit 27 that are connected to each other via a bus B1, and a storage device 24 connected via the storage device interface 25** to the bus B1.

The keyboard 11 is a device through which an operator inputs data such as characters, etc. and is connected via the keyboard interface 21 to the bus B1.

Each infrared-ray camera **13*l*–13*n* is disposed on the periphery of a monitoring target plane, takes high angle shots of a part of the monitoring target plane with the infrared rays, and inputs image data obtained by the photographing to the AD converter 23. Note that the monitoring target plane is previously sectioned into a plurality of partial areas, and individual partial area is imaged by any two of the infrared-ray cameras 13*l*–13*n* which are different in their photographing directions from each other. Further, each of the infrared-ray cameras 13*l*–13*n* is assigned to photograph any one of the partial areas. Accordingly, there are required the infrared-ray cameras 13*l*–13*n*, the number of which is twice the number of the whole partial areas of the monitoring target plane. Those infrared-ray cameras 13*l*–13*n*** corresponds to an infrared-ray imaging device.

The display device 12 displays images taken by the infrared-ray cameras **13*l*–13*n* and the characters, etc. inputted through the keyboard 11**.

The computer 20 processes image data transmitted from the infrared-ray cameras **13*l*–13*n*, and makes the display device 12 display the images of the monitoring target plane. The computer 20 then judges whether or not a fire occurs within the monitoring target plane on the basis of respective pieces of image data. The keyboard interface 21 transmits input data from the keyboard 11 to the bus B1. The display device interface 22 gets the display device 12 to display the characters, the images and so on. The AD converter 23 converts a format of the image data inputted by the infrared-ray cameras 13*l*–13*n* into digital format consisting of density data of a grey scale, and transmits the image data of the digital format to the bus B1. This AD converter 23 corresponds to a converting means. The storage device 24 is a hard disk storing a control processing program executed by the control unit 27, and fiducial image data, etc. Herein, the fiducial image data is prepared for each of the infrared-ray cameras 13*l*–13*n*, which is obtained by photographing the partial areas allocated to the respective infrared-ray cameras 13*l*–13*n* when no fire happens in those partial areas. This storage device 24 corresponds to a storing means. The storage device interface 25 writes and reads the data to and from the storage device 24. The memory 26 is constructed of a RAM, etc. and used for operations by the control unit 27. The control unit 27 is constructed of a CPU, etc., gives a screen display instruction to the display device interface 22, and gives a data write or read instruction to the storage device interface 25. The control unit 27 receives the input data from the keyboard interface 21 and the image data from the AD converter 23, respectively. The control unit 27 executes a process for the input data inputted through the keyboard 11, a process of generating the image data to be displayed on the display device 12, and a process for the image data inputted from the AD converter 23. This control unit 27** corresponds to a detecting means, a calculating means and a controlling means.

Figure 2:
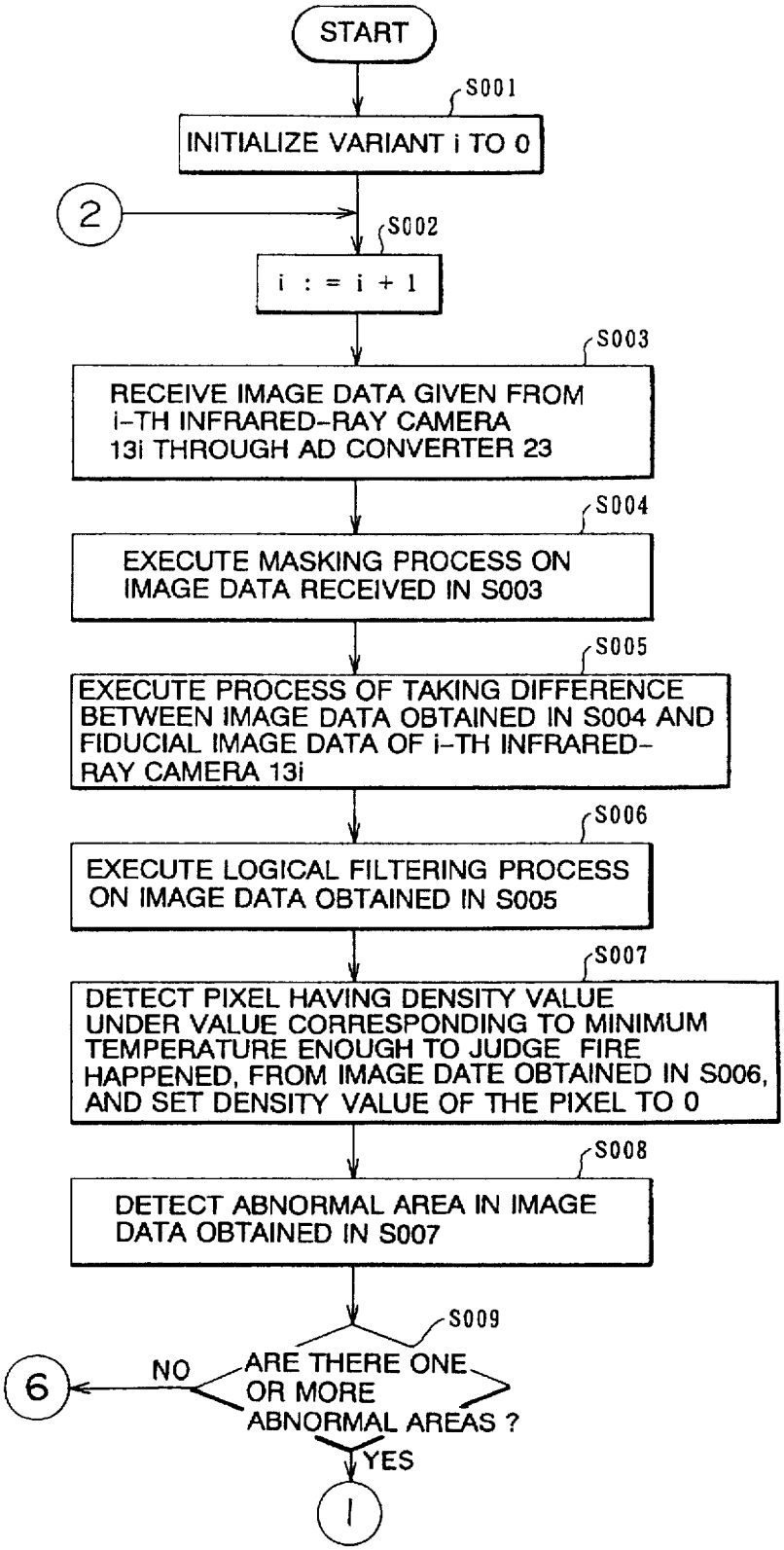
FIG. 2 is a flowchart showing a control process executed by a control unit shown in FIG. 1.
Figure 3:
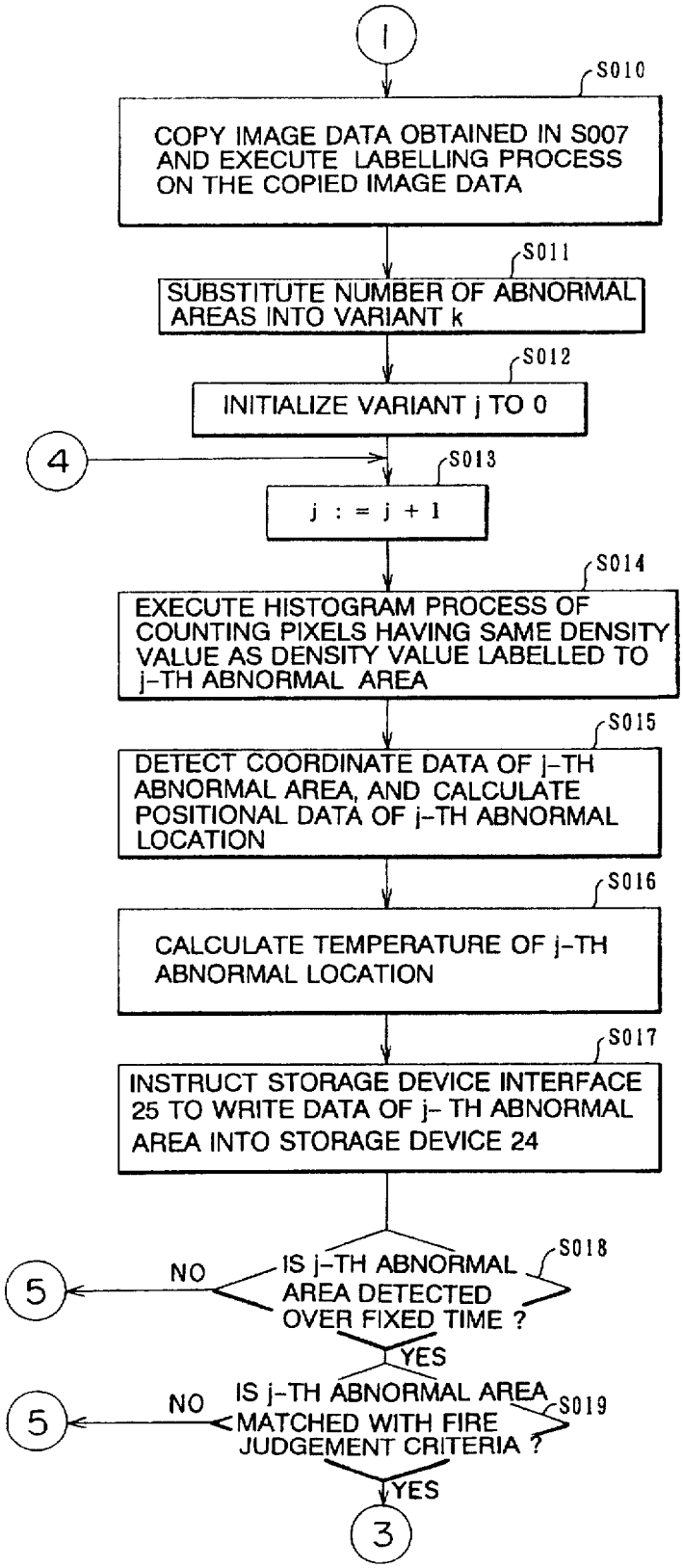
FIG. 3 is a flowchart showing the control process executed by the control unit shown in FIG. 1.
Figure 4:
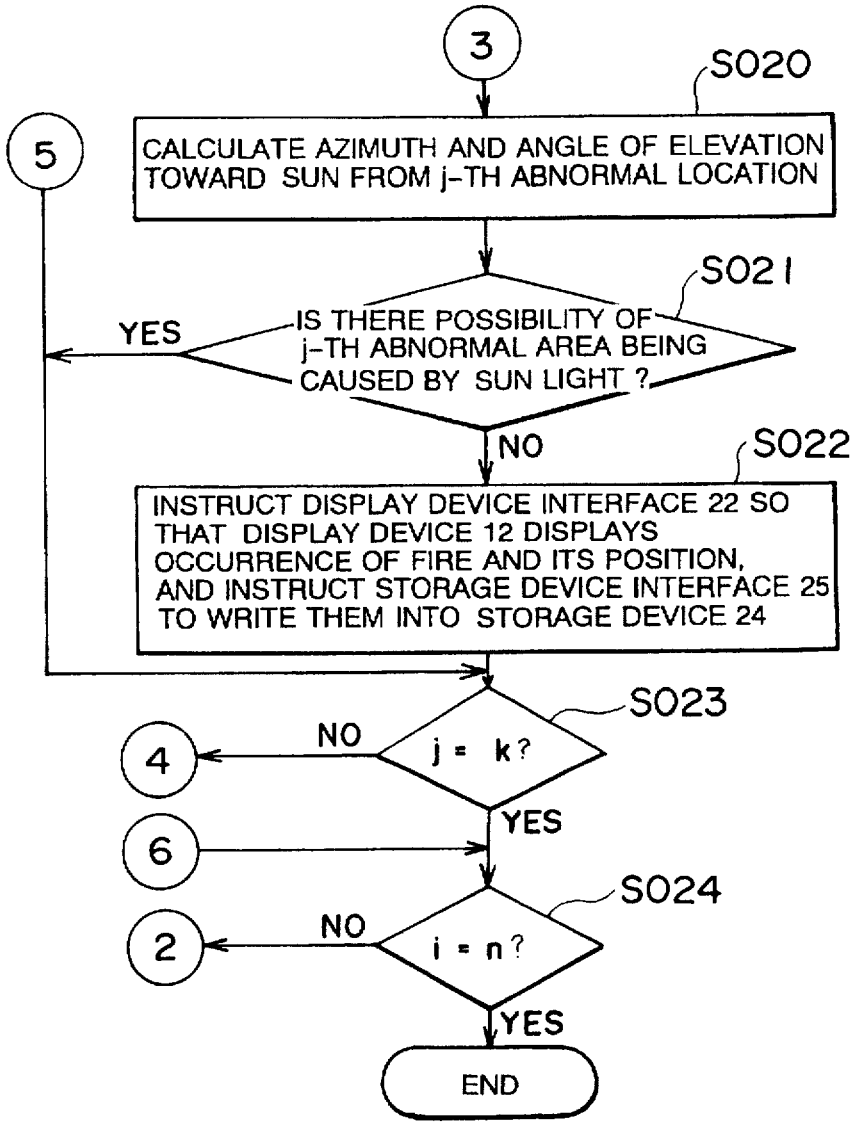
FIG. 4 is a flowchart showing the control process executed by the control unit shown in FIG. 1.

Next, the fire monitoring program which is stored in the storage device 24 as a computer readable medium and executed by the control unit 27, will be explained with reference to flowcharts of FIGS. 2 through 4. The control unit 27 of the fire monitoring apparatus 10 executes this fire monitoring program at a fixed time interval after a main power supply is switched ON.

In first step SOO1 after starting this fire monitoring program, the control unit 27 initializes a variant i to O.

In next step SOO2, the control unit 27 increments the variant i.

In subsequent step SOO3, the control unit 27 receives the image data from the i-th infrared-ray camera **13*i* through the AD converter 23. Simultaneously with this process, the control unit 27 writes a date and a time when the i-th infrared-ray camera 13*i* takes a photograph for obtaining this piece of image data, into the memory 26**.

In next step SOO4, the control unit 27 executes a masking process on pixels which do not correspond to the partial areas assigned to the i-th infrared-ray camera **13*i*** among the pixels constituting the image data received in step SOO3. This masking process is a process for setting a density value of a processing target pixel to 0.

In next step SOO5, the control unit 27 performs a process of taking a difference between the image data obtained in step SOO4 and the fiducial image data of the i-th infrared-ray camera 13*i*.

In next step SOO6, the control unit 27 executes a logical filtering process for eliminating noises with respect to the image data obtained in step SOO5.

In next step SOO7, the control unit 27 detects pixels having density values lower than a value corresponding to a minimum temperature enough to judge fire being happened, in the image data obtained in step SOO6. The control unit 27 sets the density values of the detected pixels to 0. The image data processed in step SOO7 are termed "original image data".

In next step SOO8, the control unit 27 detects abnormal pixels, that is, pixels having density values higher than the value corresponding to the minimum temperature enough to judge fire being happened, in the original image data. Then, the control unit 27 treats an abnormal pixel which is isolated and which is not adjacent to any of other abnormal pixels as one abnormal area. Besides, the control unit 27 treats a plurality of entire abnormal pixels adjacent to each other as one abnormal area.

In next step SOO9, the control unit 27 checks whether or not one or more abnormal areas are detected in step SOO8. If none of the abnormal areas is detected, the control unit 27 judges that no fire occurs in the partial area assigned to the i-th infrared-ray camera 13*i*, and the processing proceeds to step SO24. On the contrary, if detecting an abnormal areas, the control unit 27 executes step SO10.

In step SO10, the control unit 27 copies the original image data. Then, the control unit 27 executes a labelling process for allocating unique values (=1 to m) for every abnormal area detected in step SOO8, with respect to the image data (hereinafter referred to as copied image data) that have been just copied. In this labelling process, the control unit 27 rewrites the density values of all the pixels constituting an abnormal area into values allocated to the same abnormal area, for every abnormal area in the copied image data. Then, the control unit 27 instructs the storage device interface 25 to write the copied image data that has been subjected to the labelling process, into the storage device 24.

In next step SO11, the control unit 27 substitutes a total number m of the abnormal areas into a variant k.

In next step SO12, the control unit 27 initializes a variant j to O.

Subsequently, the control unit 27 executes a loop of processes of steps SO13 to SO23. In first step SO13 after entering this loop, the control unit 27 increments the variant j.

In next step SO14, the control unit 27 executes a histogram process for counting the number of pixels having the same density value as the value labelled to the j-th abnormal area on the basis of the copied image data, thereby obtaining an areal size of the j-th abnormal area.

In next step SO15, the control unit 27 detects a coordinate position of the J-th abnormal area in the original image data. Then, the control unit 27 calculates a latitude and a longitude (hereinafter called "positional data") of a location corresponding to the j-th abnormal area (which is hereinafter referred to as a "j-th abnormal location") on the actual monitoring target plane, on the basis of the detected coordinate position.

In next step SO16, the control unit 27 extracts the density values of all the pixels constituting the j-th abnormal area in the original image data, and calculates a maximum temperature within the j-th abnormal location on the basis of the maximum value thereof.

In subsequent step SO17, the control unit 27 instructs the storage device interface 25 to write the areal size, the positional data and the maximum temperature of the j-th abnormal area into the storage device 24.

In next step SO18, the control unit 27 checks whether or not the j-th abnormal area continues to be detected as an abnormal area for a predetermined period or longer, i.e., whether or not the same positional data as that of the j-th abnormal area is written over a predetermined number of times into the storage device with the executions of the fire monitoring program over a plurality of times in the past. Then, if the j-th abnormal area is not continuous to be detected as the abnormal area for the predetermined period or longer, the control unit 27 judges that an occurrence of the fire is not yet ascertained, and the processing proceeds to step SO23. Whereas if the j-th abnormal area is continuous to be detected as abnormal area for the predetermined period or longer, the control unit 27 makes the processing proceed to step SO19.

In step SO19, the control unit 27 checks whether or not the j-th abnormal area is coincident with fire judgement criteria. More specifically, on the basis of the number of pixels that is counted in step SO14, the control unit 27 checks whether or not the number of pixels contained in the j-th abnormal area is over the number of pixels enough to recognize the fire. Based on the temperature obtained in step SO16, the control unit 27 further checks whether or not a temperature of the abnormal location corresponding to the j-th abnormal area is over a temperature enough to recognize fire. Subsequently, the control unit 27, if the j-th abnormal area does not satisfy even one of those fire judgement criteria, judges that the j-th abnormal area is not attributed to a fire and moves the processing forward to step SO23. Whereas if the j-th abnormal area satisfies all the fire judgement criteria, the processing proceeds to step SO20.

In step SO20, the control unit 27 calculates an azimuth and an angle of elevation for the sun at the j-th abnormal location based on the date and the time when the i-th infrared-ray camera 13*i* photographed to obtain the image data to be processed as well as on the latitude and the longitude of the j-th abnormal location. The azimuth and the angle of elevation for the sun at the j-th abnormal location can be calculated based on a calculation algorithm written in, e.g., "Calculation of Position of the Celestial Body (enlarged edition)" (the enlarged edition, the second print issued May 15, 1987), published by Chijinsho-Kan Inc., the disclosure of which is herein incorporated by reference. Briefly speaking, a Universal time is calculated from the date and the time. Next, a position of the sun in the geocentric coordinate system is calculated based on the thus calculated Universal time by the simplified calculation formula for the solar position. Then, the solar position in the equatorial rectangular geocentric coordinate system is coordinate-converted into a solar position in the G-system rectangular geocentric coordinate system. Furthermore, the solar position in the G-system rectangular geocentric coordinate system is coordinate-converted into a solar position in the G-system topocentric rectangular coordinate system on the basis of the latitude and the longitude of the j-th abnormal location. Then, the solar position in the G-system topocentric rectangular coordinate system is converted into a solar position in the horizon rectangular coordinate system, thereby an azimuth and an angle of elevation for the sun at the j-th abnormal location is calculated.

In next step SO21, the control unit 27 checks whether or not there might be a possibility of the j-th abnormal area being produced due to reflected light of the sun light. This check is conducted based on whether or not the solar azimuth at the j-th abnormal location is coincident with an azimuth from the i-th infrared-ray camera 13*i* to the J-th abnormal location, and on whether or not the angle of elevation for the sun at the j-th abnormal location is coincident with an angle of depression, to the j-th abnormal location, from the i-th infrared-ray camera 13*i*. Then, if both of the azimuth and the angle are coincident, the control unit 27 judges that the j-th abnormal area is attributed to the reflected light of the sun light, and makes the processing proceed to step SO23. Whereas if one of the azimuth and the angle is not coincident, the control unit 27 judges that the j-th abnormal area is attributed to fire, and makes the processing proceed to step SO22.

In step SO22, the control unit 27 instructs the display device interface 22 so that the display device 12 displays character information indicating occurrence of fire and a positional data of the fire, i.e., the positional data of the j-th abnormal location. Simultaneously, the control unit 27 instructs the storage device interface 25 to write the fact of the fire being happened and the positional data of the j-th abnormal location to the storage device 24. After the processes given above, the control unit 27 makes the processing proceed to step SO23.

In step SO23, the control unit 27 checks whether or not the variant j is equal to the variant k. Then, if the variant j is unequal to the variant k, the processing returns to step SO13.

If the variant j is equalized to the variant k as a result of repeating the loop of steps SO13 through SO23 described above, the control unit 27 exits this loop at SO23, and the processing proceeds to step SO24.

In step SO24, the control unit 27 checks whether or not the variant i is equal to a variant n. Then, if the variant i is unequal to the variant n, the processing returns to step SOO2 in order to execute the process on image data given from the next infrared-ray camera.

In contrast with this, when the processes on image data given from all the infrared-ray cameras 13*l*–13*n* have been completed, the variant i is equalized to the variant n. In this case, the control unit 27 finishes the fire monitoring program.

Note that the azimuth and the angle of elevation for the sun at each abnormal location are calculated in this embodiment. Instead of this calculation, the monitoring target plane may be subdivided into small regions, and the storage device 24 may be stored with a table containing a date and a time zone when the reflected light of the sun light falls upon each of the infrared-ray cameras for every small region. In this case, the control unit 27 retrieves this table based on a date and a time.

Figure 5:
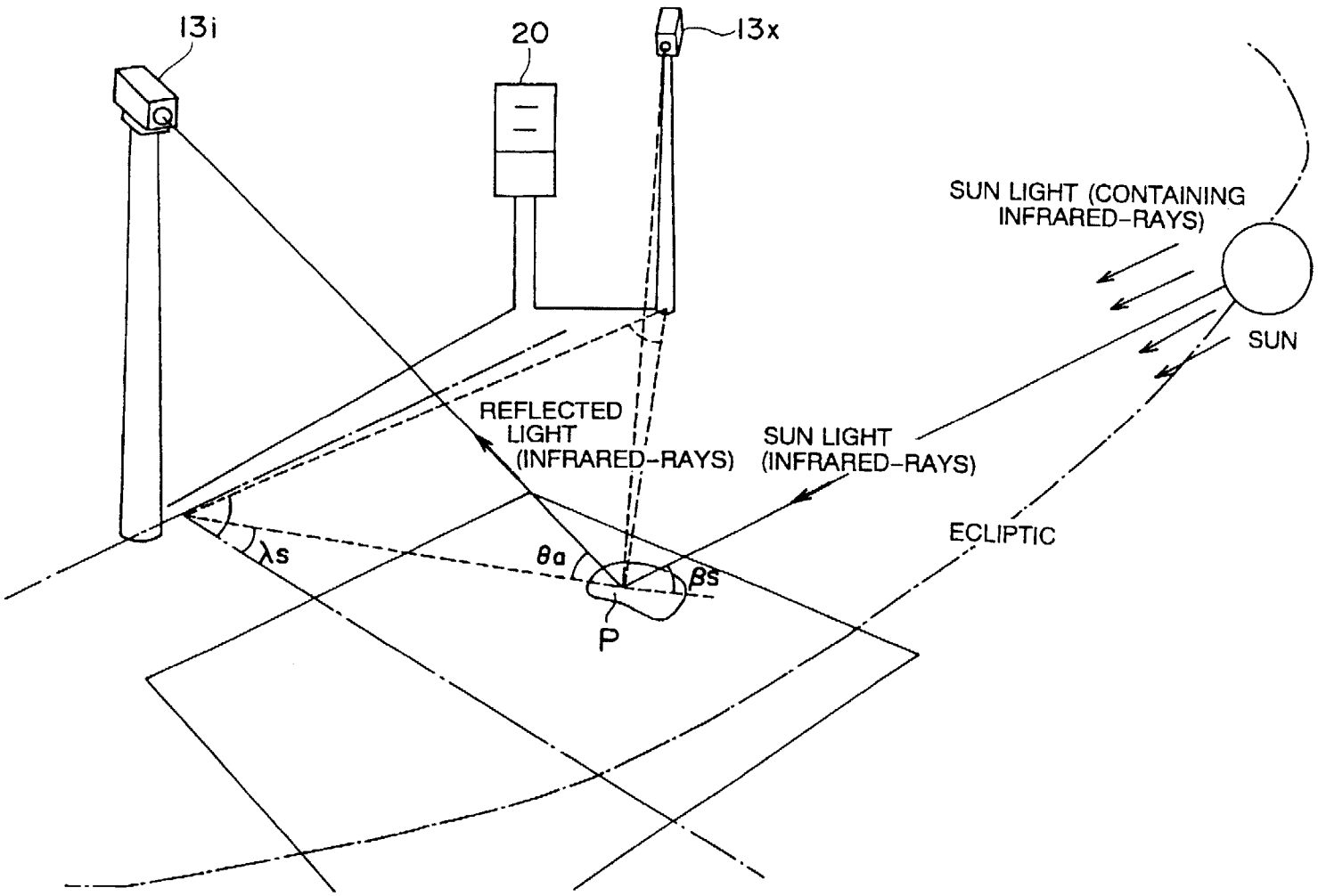
FIG. 5 is a conceptual view illustrating how reflected light of the sun light is incident upon an infrared-ray camera shown in FIG. 1.
Figure 6:
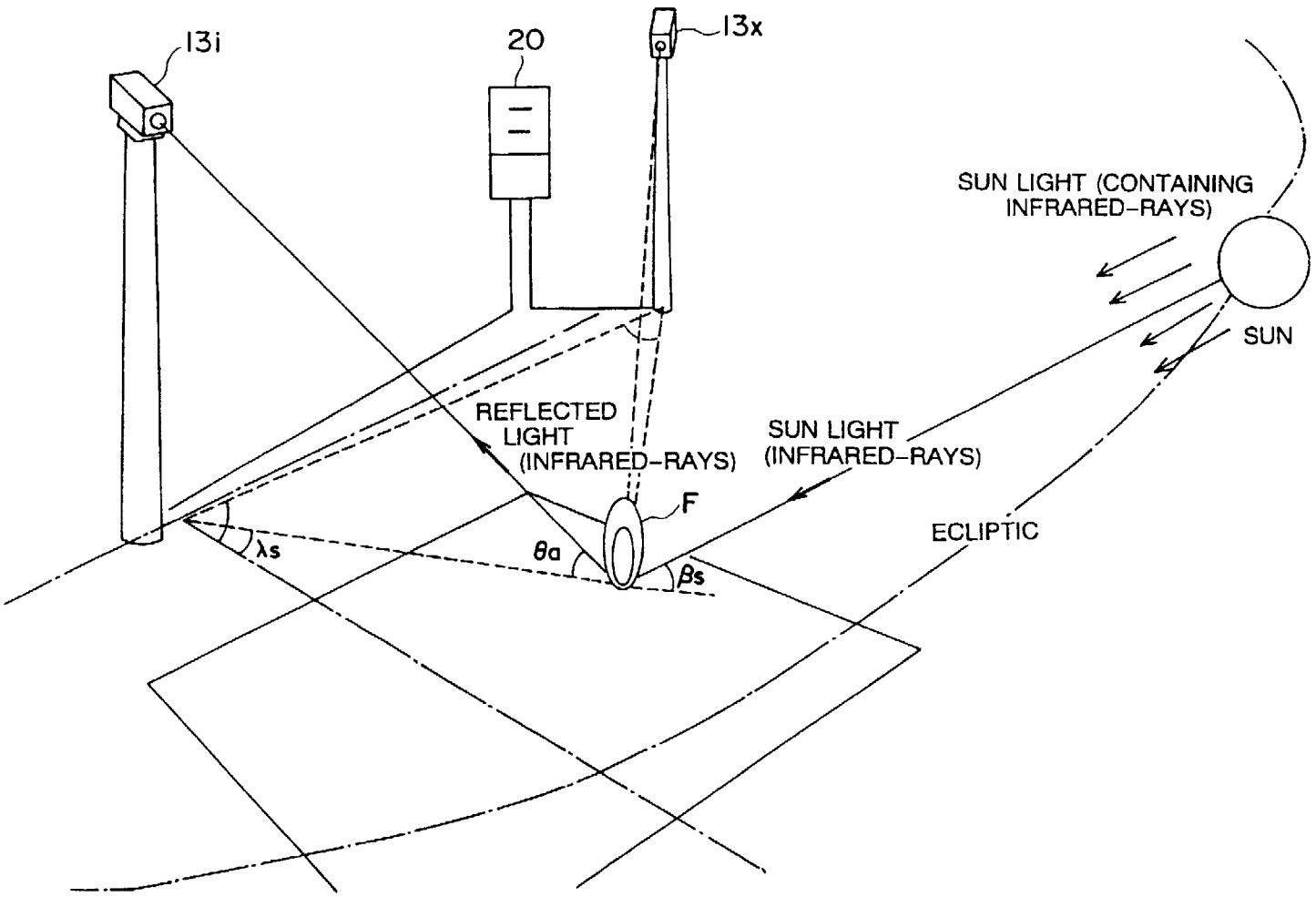
FIG. 6 is a conceptual view illustrating how infrared-rays caused by a fire are incident upon the infrared-ray camera shown in FIG. 1.

Next, the operation of this embodiment will be explained with reference to FIGS. 5 and 6. FIG. 5 shows an example where a puddle P exists within the monitoring target plane. Referring to FIG. 5, the sun light reflected by the puddle P is incident upon the i-th infrared-ray camera 13*i*. In such a case, the prior art fire monitoring apparatus tends to judge that a fire occurs in the location where the puddle P exists. In accordance with this embodiment, the control unit 27 in the fire monitoring apparatus 10 detects an abnormal area in the image data given from the i-th infrared-ray camera 13*i*. The control unit 27, however, calculates an azimuth and an angle of elevation for the sun at the location of the puddle P, and thereby judges that the abnormal area is caused by the reflected light of the sun light. Accordingly, the control unit 27 in the fire monitoring apparatus 10 in this embodiment never mis-recognizes that fire happens. Further, FIG. 6 shows an example where a fire F occurs within the monitoring target plane. Referring to FIG. 6, the infrared-rays emerging from the fire F strike on the i-th infrared-ray camera 13*i*. In this case, the control unit 27 in the fire monitoring apparatus 10 detects an abnormal area in the image data given from the i-th infrared-ray camera 13*i*. The control unit 27, however, calculates an azimuth and an angle of elevation for the sun at the location where the fire occurs, and judges that the abnormal area is caused due to the reflected light of the sun light. On the other hand, since the respective infrared-ray cameras 13*l*–13*n* are installed so that all the partial areas within the monitoring target plane are photographed by a plurality of infrared-ray cameras, the fire occurrence location is also photographed by the x-th infrared-ray camera 13*x* as well as the i-th infrared-ray camera 13*i*. Hence, the control unit 27 also detects the abnormal area in the image data given from the x-th infrared-ray camera 13*x*. Then, the control unit 27 compares an azimuth to the fire occurred location from the x-th infrared-ray camera 13*x* with the azimuth for the sun at the fire occurred location, and compares an angle of depression to the fire occurred location from the x-th infrared-ray camera 13*x* with the angle of elevation for the sun at the fire occurred location, thereby judging that the abnormal area is not caused by the reflected light of the sun light, i.e., that the fire happens. Accordingly, the control unit 27 in the fire monitoring apparatus 10 in this embodiment never mis-recognizes that the fire does not occur.

Figure 7:
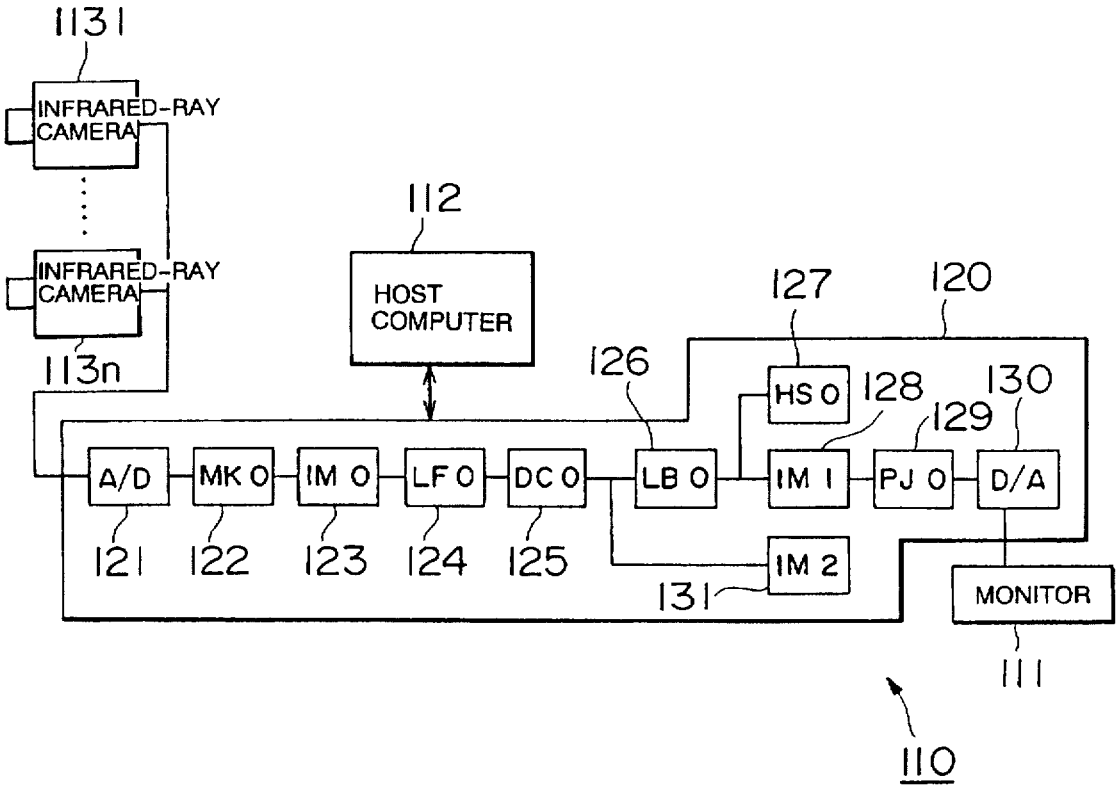
FIG. 7 is a block diagram showing a construction of a modified example of the fire monitoring apparatus in the first embodiment of the present invention.

Next, FIG. 7 illustrates a construction of a modification of this embodiment. Referring to FIG. 7, a fire monitoring apparatus 110 comprises an image processor 120, a monitor 111, a host computer 112, and N-sets of infrared-ray cameras 113*l*–113*n*, which are respectively connected to the image processor 120. The image processor 120 is constructed of an A/D converting section 121, a mask section 122, a first image memory 123, a logic filter section 124, a data converting section 125, labelling section 126, a density histogram section 127, a second image memory 128, a projection section 129, a D/A converting section 130, and a third image memory 131.

Each infrared-ray camera 113*l*–113*n* takes high angle shots of a part of the monitoring target plane with the infrared-rays, and inputs the image data obtained by the shots into the image processor 120.

The A/D converting section 121 converts a format of the image data coming from the infrared-ray cameras 113*l*–113*n* into digital format consisting of density data of the grey scale, and input the image data of the digital format into the mask section 122.

The mask section 122 sets, to 0, density values of the pixels which do not correspond to the monitoring target plane in the image data received from the AID converting section 121.

The first image memory 123 is a memory for holding the image data coming from the mask section 122.

The logic filter section 124 executes a logic filtering process on the image data held by the first image memory 123.

The data converting section 125 detects the pixels having density value lower than a fixed density value, in the image data from the logic filter section 124, and sets the density values of these pixels to 0.

The labelling section 126 performs labelling to each abnormal area in the image data from the data converting section 125.

The density histogram section 127 counts the number of pixels for every density value in the image data from the labelling section 126.

The second image memory 128 is a memory for holding the image data from the labelling section 126.

The projection section 129 calculates a coordinate position of the abnormal area in the image data held by the second image memory 128, and also calculates positional data on the monitoring target plane which corresponds to each abnormal area from the thus calculated coordinate position.

The D/A converting section 130 converts the positional data from the projection section 129 into image signals.

The third image memory 131 is a memory for holding the image data from the data converting section 125.

The monitor 111 displays a image on the basis of the image signals transmitted from the D/A converting section 130.

The host computer 112 receives the image data held by the third image memory 131. The host computer 112 calculates a temperature in each location within the monitoring target plane from the density value of each pixel in the image data. Further, the host computer 112 calculates a size of the abnormal area based on the number of pixels that is counted by the density histogram section 127. Moreover, the host computer 112 calculates a position of the abnormal location on the basis of the positional data calculated by the projection section 129. The host computer 112 also calculates an azimuth and an angle of elevation for the sun at each abnormal location, and judges whether or not the abnormal area is caused by the sun light. Then, when judging that the abnormal area is not caused by the sun light, the host computer 112 judges that the fire happens within the monitoring target plane.

SECOND EMBODIMENT

Figure 8:
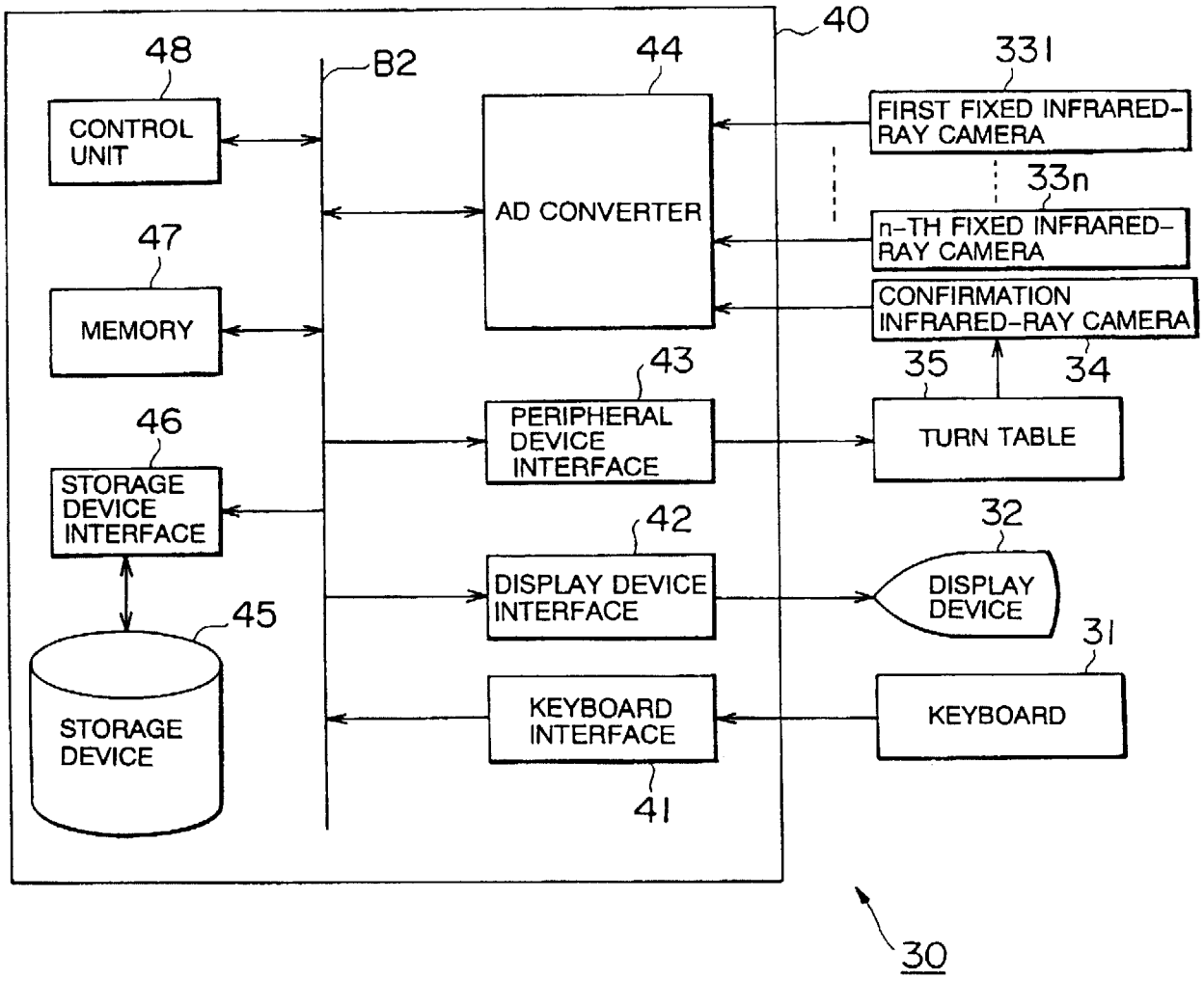
FIG. 8 is a block diagram showing a construction of the fire monitoring apparatus in a second embodiment of the present invention.
Figure 9:
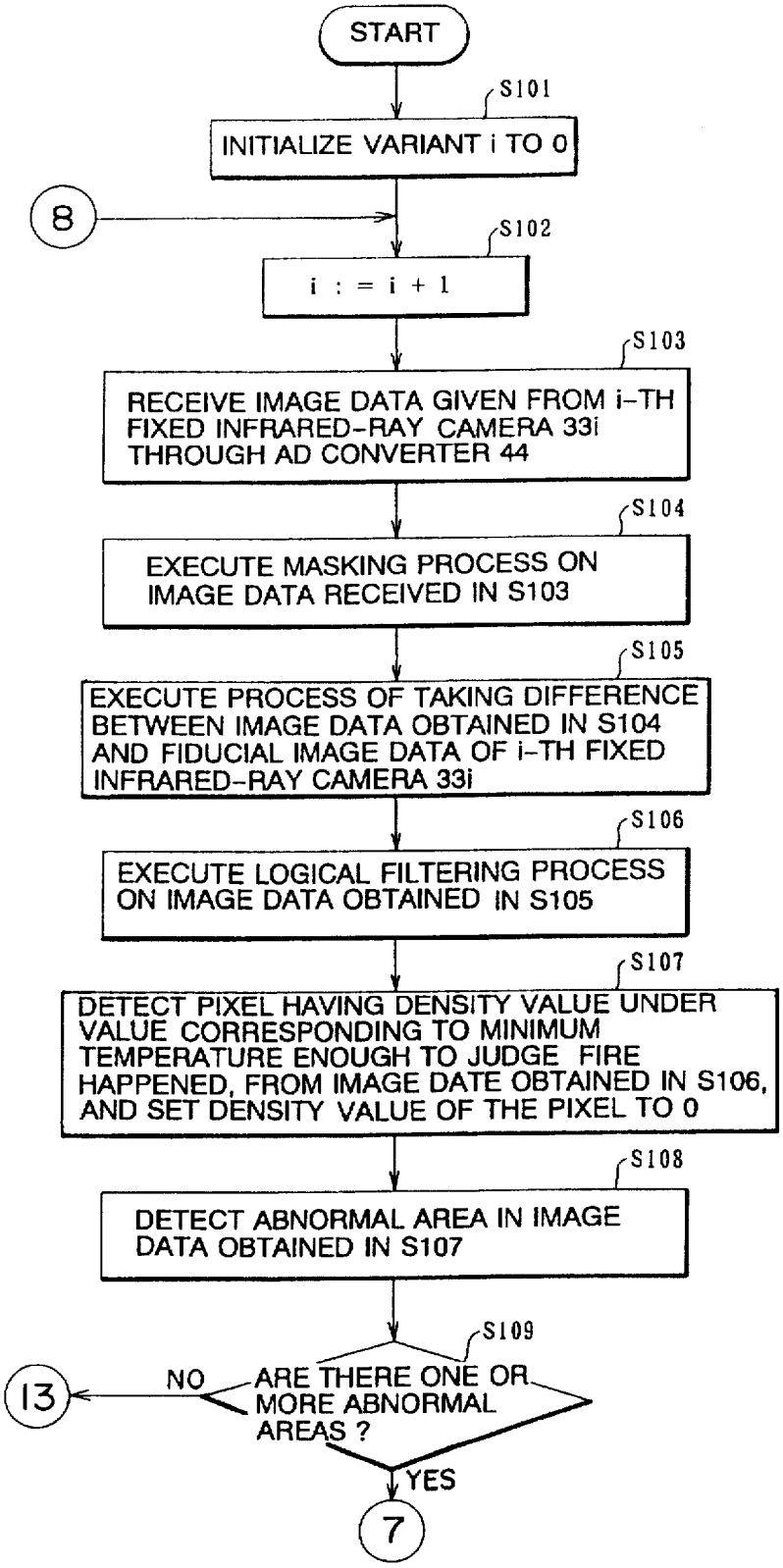
FIG. 9 is a flowchart showing a control process executed by the control unit shown in FIG. 8.
Figure 10:
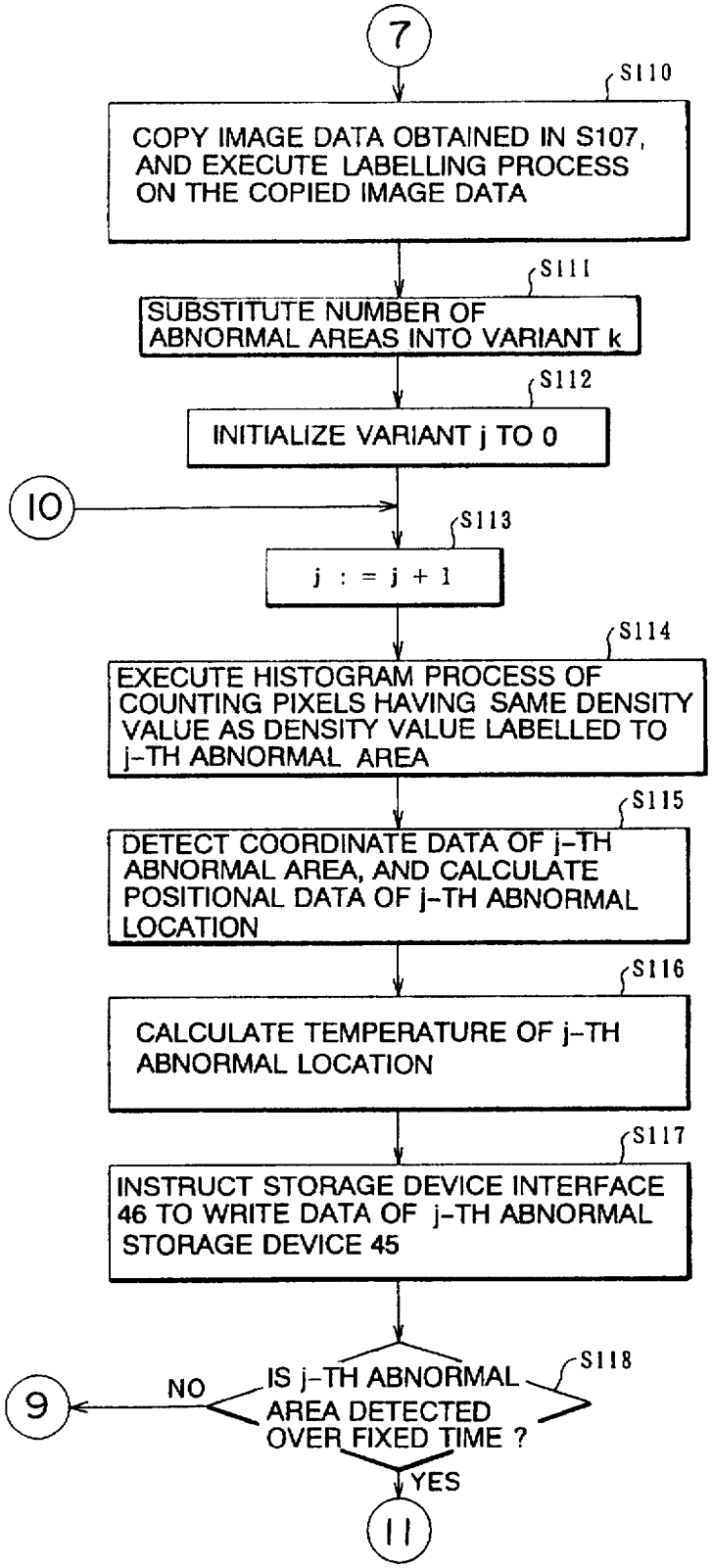
FIG. 10 is a flowchart showing the control process executed by the control unit shown in FIG. 8.
Figure 11:
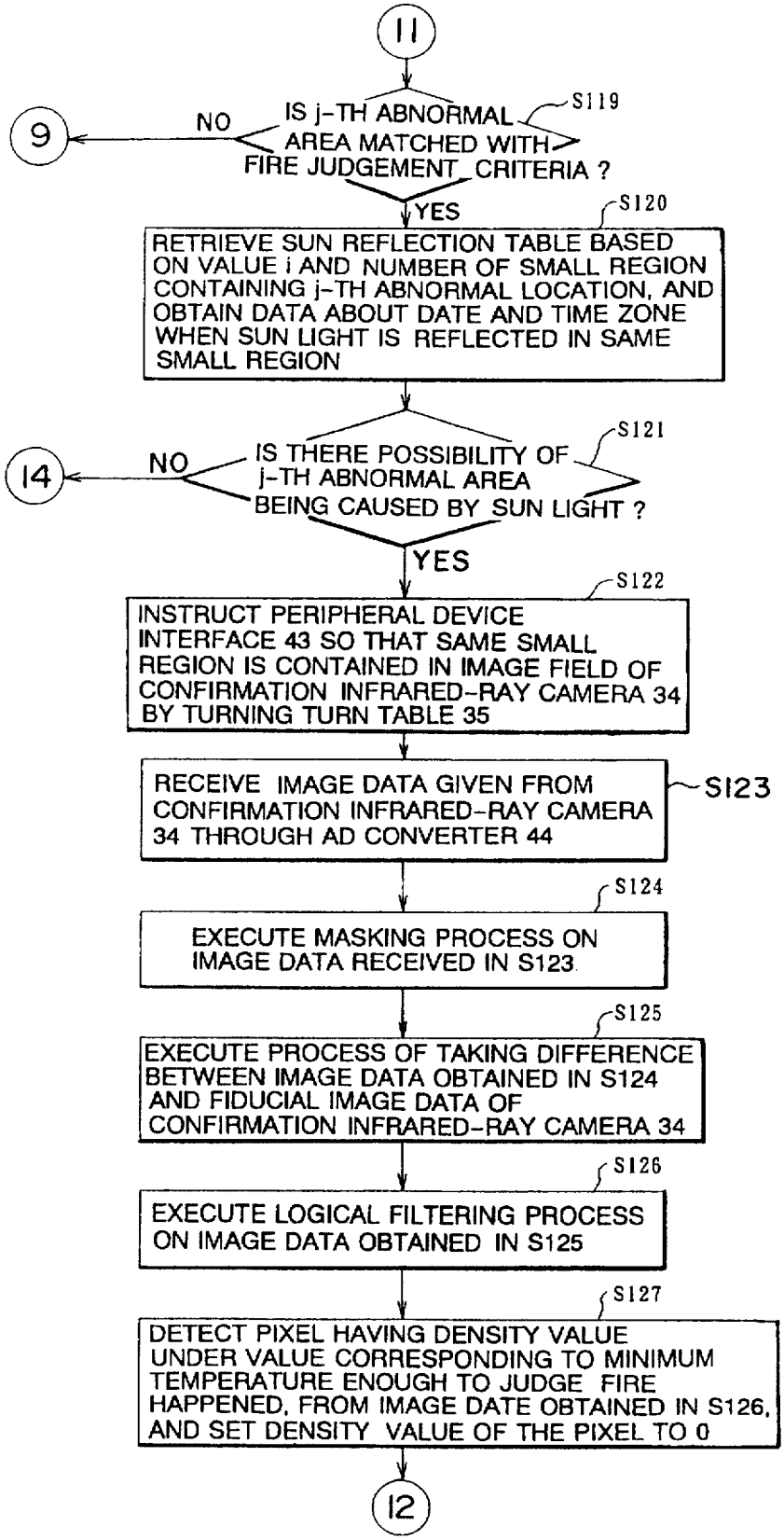
FIG. 11 is a flowchart showing the control process executed by the control unit shown in FIG. 8.
Figure 12:
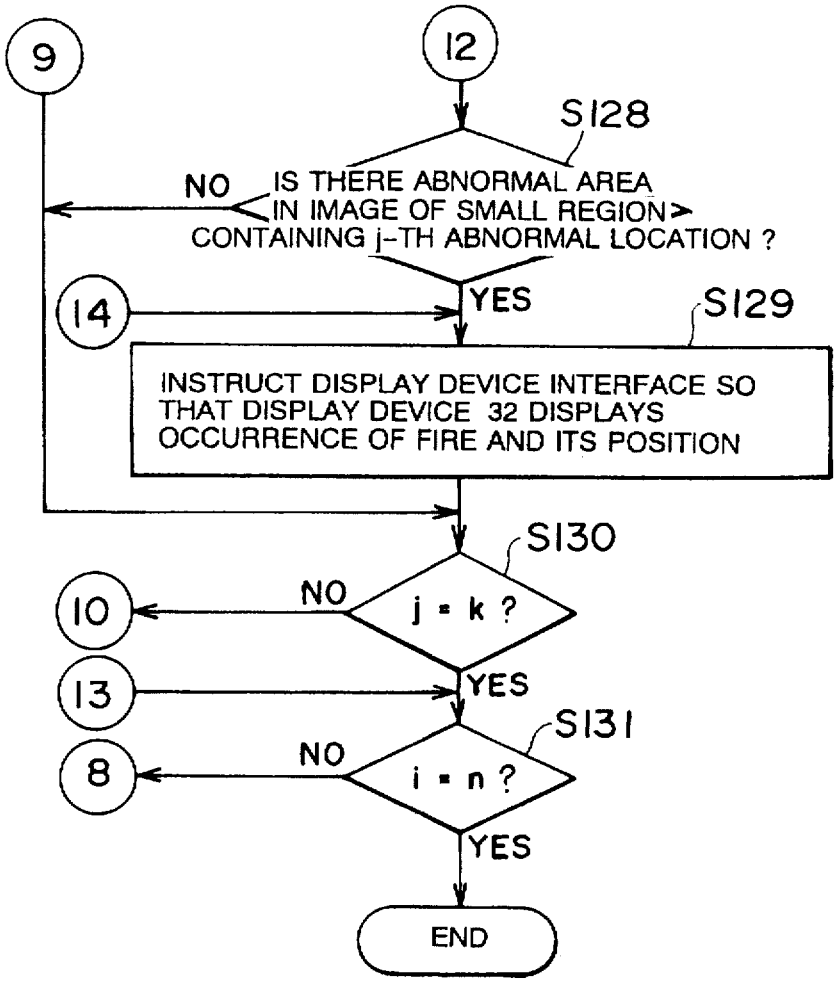
FIG. 12 is a flowchart showing the control process executed by the control unit shown in FIG. 8.

FIG. 8 is a block diagram illustrating a construction of a fire monitoring apparatus 30 in a second embodiment of the present invention. Referring to FIG. 8, the fire monitoring apparatus 30 is constructed of a keyboard 31, a display device 32, n-sets of monitor infrared-ray cameras **33*l*–33*n*, confirmation infrared-ray camera 34, a turn board 35 and a computer 40. This computer 40 is constructed of a keyboard interface 41, a display device interface 42, a peripheral device interface 43, an AD converter 44, a storage device interface 46, a memory 47, a control unit 48 that are connected to each other via a bus B2, and a storage device 45 connected via the storage device interface 46** to the bus B2.

The keyboard 31 is a device through which an operator inputs data such as characters, etc. and is connected via the keyboard interface 41 to the bus B2.

Each monitor infrared-ray cameras **33*l*–33*n* is disposed on the periphery of a monitoring target plane, takes high angle shots of a part of the monitoring target plane with the infrared rays, and inputs image data obtained by the photographing to the AD converter 44. Note that the monitoring target plane is previously sectioned into a plurality of partial areas, and individual partial area is imaged by any one of the monitor infrared-ray cameras 33*l*–33*n*. Further, each of the monitor infrared-ray cameras 33*l*–33*n* is assigned to photograph any one of the partial areas. These monitor infrared-ray cameras 33*l*–33*n*** correspond to an infrared-ray imaging device.

The confirmation infrared-ray camera 34 photographs, if an abnormal area is detected in the image data given from the monitor infrared-ray cameras **33*l*–33*n*, an abnormal location corresponding to this abnormal area in a direction different from the photographing direction of each of the monitor infrared-ray cameras 33*l*–33*n*. This confirmation infrared-ray camera 34 is mounted on the turn table 35 connected to the peripheral device interface 43, and inputs the image data obtained by photographing to the AD converter 44. This confirmation infrared-ray camera 34** corresponds to a confirmation infrared-ray imaging device.

The display device 32 displays images taken by each of the monitor infrared-ray cameras **33*l*–33*n*, or an image taken by the confirmation infrared-ray camera 34, and characters, etc. inputted through the keyboard 31**.

The turn table 35 constructed of a motor and gears turns the confirmation infrared-ray camera 34 in horizontal and perpendicular directions in accordance with an instruction given from the peripheral device interface 43. The confirmation infrared-ray camera 34 is turned by this turn table 35 and is thereby capable of photographing all the partial areas within the whole monitoring target plane, which are assigned to the respective monitor infrared-ray cameras **33*l*–33*n*. Further, the turn table 35 and the confirmation infrared-ray camera 34 are installed in such locations that no reflected light of the sun light is incident upon the confirmation infrared-ray camera 34 even when the confirmation infrared-ray camera 34 is turned in whichever direction by the turn table 35. This turn table 35** corresponds to a turning means.

The computer 40 processes image data transmitted from the monitor infrared-ray cameras **33*l*–33*n* and from the confirmation infrared-ray camera 34, and makes the display device 32 display the images of the monitoring target plane. The computer 40 then judges whether or not the fire occurs within the monitoring target plane on the basis of respective pieces of image data. The keyboard interface 41 transmits input data from the keyboard 31 to the bus B2. The display device interface 42 gets the display device 32 to display the characters, the images and so on. The peripheral device interface 43 makes the turn table 35 turn the confirmation infrared-ray camera 34. The AD converter 44 converts a format of the image data received from the monitor infrared-ray cameras 33*l*–33*n* and the confirmation infrared-ray camera 34 into digital format consisting of density data of a grey scale, and transmits the image data of the digital format to the bus B2. This AD converter 44 corresponds to a converting means. The storage device 45 is a hard disk for storing a control processing program executed by the control unit 48, fiducial image data, segmenting data, and a sun reflection table. Herein, the fiducial image data is prepared for every partial area of the monitoring target plane, which is obtained by such a process that the monitor infrared-ray cameras 33*l*–33*n* and the confirmation infrared-ray camera 34 to which the partial areas are assigned, photograph these partial areas when no fire occurs in those partial areas. The segmenting data consist of data for respectively segmenting the partial areas assigned to the monitor infrared-ray cameras 33*l*–33*n*, and numeral data univocally allocated for every partial area. The sun reflection table is a table in which the data about the date and time zone when the reflected light of the sun light is incident upon each monitor infrared-ray cameras 33*l*–33*n* from partial area assigned thereto, are made correspond to the numeral data allocated to the partial area. The storage device 45 corresponds to a storing means. The storage device interface 46 writes and reads the data to and from the storage device 45. The memory 47 is constructed of a RAM, etc. and used for operations by the control unit 48. The control unit 48 is constructed of a CPU, etc., gives a screen display instruction to the display device interface 42, instructs the peripheral device interface 43 to turn the turn table 35, and gives a data write or read instruction to the storage device interface 46. The control unit 48 receives the input data from the keyboard interface 41 and the image data from the AD converter 44, respectively. The control unit 48 executes a process for the input data inputted through the keyboard 31, a process of generating the image data to be displayed on the display device 32, and a process for the image data inputted from the AD converter 44. This control unit 48** corresponds to a detecting means, a calculating means and a controlling means.

Next, the fire monitoring program stored in the storage device 45 as a computer readable medium and executed by the control unit 48, will be described with reference to flowcharts of FIGS. 9 through 12. The control unit 48 of the fire monitoring apparatus 30 executes this fire monitoring program at a fixed time interval after a main power supply is switched ON.

In first step S101 after starting this fire monitoring program, the control unit 48 initializes a variant i to O.

In next step S102, the control unit 48 increments the variant i.

In subsequent step S103, the control unit 48 receives the image data from the i-th monitor infrared-ray camera **33*i* through the AD converter 44. Simultaneously with this process, the control unit 48 writes a date and a time when the i-th monitor infrared-ray camera 33*i* takes a photograph for obtaining this piece of image data, into the memory 47**.

In next step S104, the control unit 48 executes a masking process on pixels which do not correspond to the partial areas assigned to the i-th monitor infrared-ray camera **13*i* among the pixels constituting the image data received in step S103**. This masking process is a process for setting a density value of a processing target pixel to 0.

In next step S105, the control unit 48 performs a process of taking a difference between the image data obtained in step S104 and the fiducial image data of the i-th monitor infrared-ray camera **33*i***.

In next step S106, the control unit 48 executes a logical filtering process for eliminating noises with respect to the image data obtained in step S105.

In next step S107, the control unit 48 detects pixels having density values lower than a value corresponding to a minimum temperature enough to judge fire being happened, in the image data obtained in step S106. Then, the control unit 48 sets the density values of such pixels to 0. The image data processed in step S107 are hereinafter termed "original image data".

In next step S108, the control unit 48 detects abnormal pixels, that is, pixels having density values higher than the value corresponding to the minimum temperature enough to judge fire happened, in the original image data. Then, the control unit 27 treats an abnormal pixel which is isolated and which is not adjacent to any of other abnormal pixels as one abnormal area. Besides, the control unit 27 treats a plurality of entire abnormal pixels adjacent to each other as one abnormal area.

In next step S109, the control unit 48 checks whether or not one or more abnormal areas are detected in step S108. If none of the abnormal areas is detected, the control unit 48 judges that no fire occurs in the partial area assigned to the i-th monitor infrared-ray camera **33*i*, and the processing proceeds to step S131. Whereas if an abnormal area is detected, the control unit 48 makes the processing proceed to step S110**.

In step S110, the control unit 48 copies the original image data. Then, the control unit 48 executes a labelling process for allocating unique values (=1 to m) for every abnormal area detected in step S108 with respect to the image data (hereinafter referred to as copied image data) that have been just copied. In this labelling process, the control unit 48 rewrites the density values of all the pixels constituting an abnormal area into values allocated to the same abnormal area, for every abnormal area in the copied image data. Then, the control unit 48 instructs the storage device interface 46 to write the copied image data that has been subjected to the labelling process, into the storage device 45.

In next step Sill, the control unit 48 substitutes a number of the abnormal areas into a variant k.

In next step S112, the control unit 48 initializes a variant j to O.

Subsequently, the control unit 48 executes a loop of processes of steps S113 to S130. In first step S113 after entering this loop, the control unit 48 increments the variant J.

In next step S114, the control unit 48 executes a histogram process for counting the number of pixels having the same density value as the value labelled to the j-th abnormal area on the basis of the copied image data, thereby obtaining an areal size of the j-th abnormal area.

In next step S115, the control unit 48 detects a coordinate position of the j-th abnormal area in the original image data. Then, the control unit 48 calculates a latitude and a longitude (hereinafter called "positional data") of a location corresponding to the j-th abnormal area (which is hereinafter referred to as a "j-th abnormal location") on the actual monitoring target plane, on the basis of the detected coordinate position.

In next step S116, the control unit 48 extracts the density values of all the pixels constituting the j-th abnormal area in the original image data, and calculates a maximum temperature within the j-th abnormal location on the basis of the maximum value thereof.

In subsequent step S117, the control unit 48 instructs the storage device interface 46 to write the areal size, the positional data and the maximum temperature of the j-th abnormal area into the storage device 45.

In next step S118, the control unit 48 checks whether or not the j-th abnormal area continues to be detected as an abnormal area for a predetermined period or longer, i.e., whether or not the same positional data as that of the j-th abnormal area is written over a predetermined number of times into the storage device with the executions of the fire monitoring program over a plurality of times in the past. Then, if the j-th abnormal area is not continuous to be detected as the abnormal area for the predetermined period or longer, the control unit 48 judges that an occurrence of the fire is not yet ascertained, and the processing proceeds to step S130. Whereas if the j-th abnormal area is continuous to be detected as abnormal area for the predetermined period or longer, the control unit 48 makes the processing proceed to step S119.

In step S119, the control unit 48 checks whether or not the j-th abnormal area is coincident with fire judgement criteria. More specifically, on the basis of the number of pixels that is counted in step S114, the control unit 48 checks whether or not the number of pixels contained in the j-th abnormal area is over the number of pixels enough to recognize the fire. Based on the temperature obtained in step S116, the control unit 48 further checks whether or not a temperature of the abnormal location corresponding to the j-th abnormal area is over the temperature enough to recognize the fire. Subsequently, the control unit 48, if the j-th abnormal area does not satisfy even one of those fire judgement criteria, judges that the j-th abnormal area is not attributed to a fire and moves the processing forward to step S130. Whereas if the j-th abnormal area satisfies all the fire judgement criteria, the processing proceeds to step S120.

In step S120, the control unit 48 retrieves the sun reflection table on the basis of the value of the variant i and the numeral data of the partial area containing the j-th abnormal location, and reads a date and a time zone when the reflected light of the sun light from the partial area is incident upon the i-th monitor infrared-ray camera 33*i*.

In next step S121, the control unit 48 checks whether or not there might be a possibility of the j-th abnormal area being caused due to the reflected light of the sun light. This check is conducted based on whether or not the date and the time zone that are read in step S120 include the date and the time that are written to the memory 47 in step S103. Then, if the date and the time written in step S103 are not contained in the date and the time zone read in step S120, the control unit 48 judges that the j-th abnormal area is attributed to the fire, and the processing proceeds to step S129. Whereas if the date and the time written in step S103 are contained in the date and the time zone read in step S120, the control unit 48 judges that there might be a possibility in which the j-th abnormal area is produced due to the reflected light of the sum light, and the processing proceeds to step S122.

Figure 13:
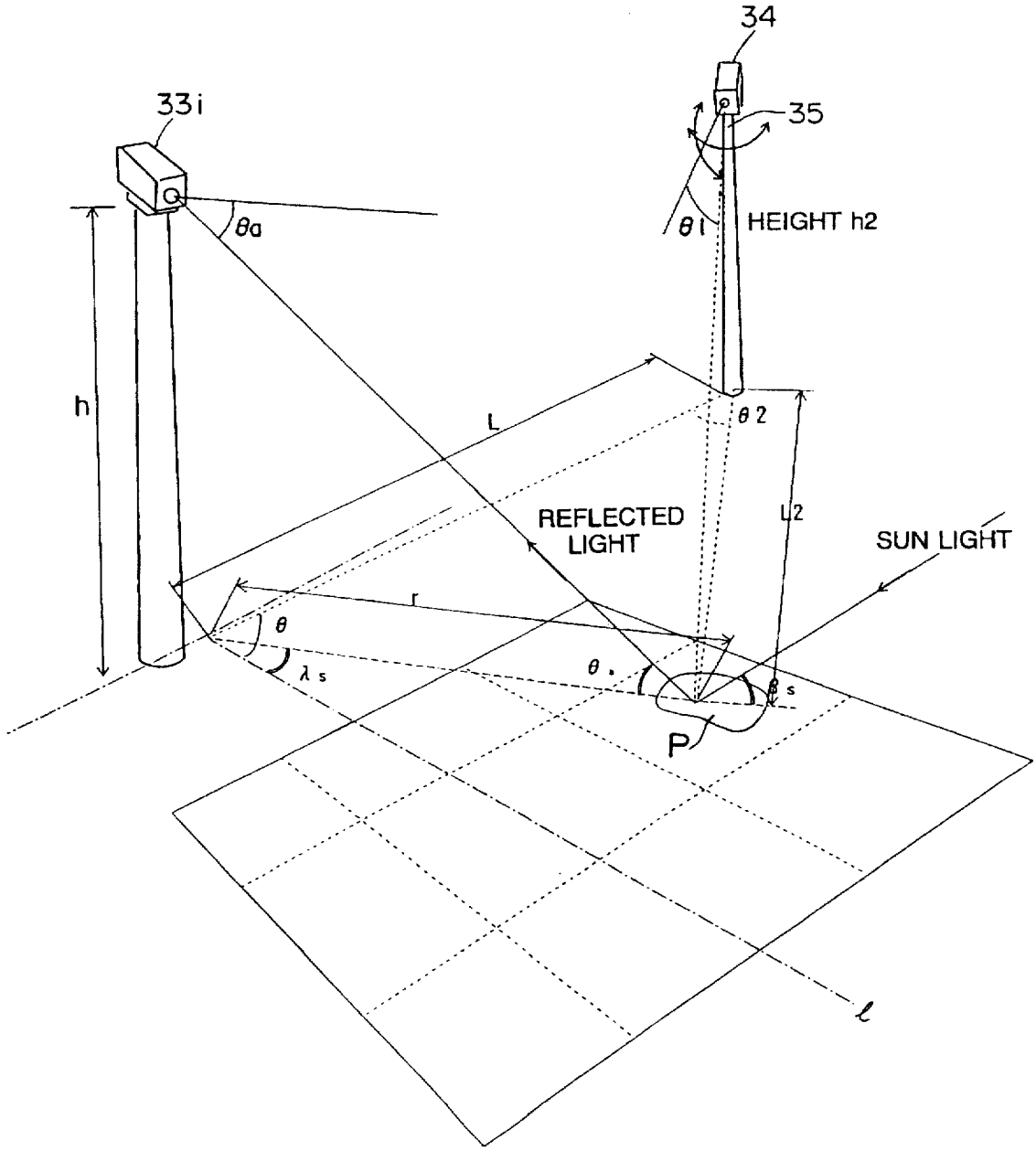
FIG. 13 is a conceptual view illustrating how the reflected light of the sun light is incident on the infrared-ray camera shown in FIG. 8.

In step S122, the control unit 48 instructs the peripheral device interface 43 so that an image field of the confirmation infrared-ray camera 34 includes the partial area containing the j-th abnormal location by turning the turn table 35. A method of calculating an angle of rotation of the turn table 35 in the perpendicular direction and an angle of rotation thereof in the horizontal direction which are instructed at that moment, will be explained with reference to FIG. 13. FIG. 13 shows a state where the partial area containing the j-th abnormal location is included in the image field of the confirmation infrared-ray camera 34 by turning the turn table 35. Referring to FIG. 13, the sun light reflected by the puddle P existing in the j-th abnormal location is incident upon the i-th monitor infrared-ray camera 33*i*. Herein, the distance r from the installed location of the i-th monitor infrared-ray camera 33*i* to the puddle P is calculated such as: $r=h\cdot\tan(90°-\theta_a)$, where h is the height at which the i-th monitor infrared-ray camera 33*i* is installed, and ea is the angle of depression of the i-th monitor infrared-ray camera 33*i* oriented to the puddle P. Further, based on the cosine theorem, the distance L2 between the installed location of the confirmation infrared-ray camera 34 and the puddle P can be calculated such as: $L2=\{L^2+r^2-2\cdot L\cdot r\cdot\cos(\theta-\lambda_s)\}^{1/2}$, where $\lambda_s$ is the azimuth toward the puddle P from the i-th monitor infrared-ray camera 33*i* on the basis of an azimuth fiducial line 9 extending in a predetermined direction from the installed location of the i-th monitor infrared-ray camera 33*i*, e is the azimuth toward the confirmation infrared-ray camera 34 from the i-th monitor infrared-ray camera 33*i* on the basis of the azimuth fiducial line Q, and L is the distance between the installed location of the i-th monitor infrared-ray camera 33*i* and the installed location of the confirmation infrared-ray camera 34. Accordingly, the angle θ1 of depression of the confirmation infrared-ray camera 34 oriented to the puddle P is calculated such as: $\theta1=90°-\tan^{-1}(L2+h2)$, where h2 is the height at which the confirmation infrared-ray camera 34 is installed. Furthermore, based on the cosine theorem, the azimuth θ2 toward the puddle P from the confirmation infrared-ray camera 34 on the basis of a line connecting the installed location of the confirmation infrared-ray camera 34 to the installed location of the i-th monitor infrared-ray camera 33*i*, is calculated such as: $\theta2=\cos^{-1}\{(L^2+L2^2-r^2)\div(2\cdot L\cdot L2)\}$. The control unit 48 turns the turn table 35 in the perpendicular direction so that an angle of depression of the confirmation infrared-ray camera 34 is coincident with the calculated angle of depression θ1, and also turns the turn table 35 in the horizontal direction so that the photographing direction of the confirmation infrared-ray camera 34 is coincident with the calculated azimuth θ2.

In next step S123, the control unit 48 receives the image data from the confirmation infrared-ray camera 34 via the AD converter 44.

In next S124, the control unit 48 executes the m asking process on the pixels which do not correspond to the monitoring target plane among the pixels constituting the image data received in step S123, to set the density values of the pixels to 0.

In step S125, the control unit 48 performs a process of taking a difference between the image data obtained in step S124 and the fiducial image data of the confirmation infrared-ray camera 34.

In next step S126, the control unit 48 executes a logical filtering process for eliminating noises with respect to the image data obtained in step S125.

In next step S127, the control unit 48 detects pixels having density values lower than a value corresponding to a minimum temperature enough to judge fire being happened, in the image data obtained in step S126. Then, the control unit 48 sets the density values of such pixels to 0.

In next step S128, the control unit 48 checks whether or not the abnormal area satisfying the fire judgement criteria exists in the portion (in the vicinity of the center of the picture) corresponding to the j-th abnormal location in the image data obtained in step S127. Then, if such abnormal area does not exist, the control unit 48 judges that the j-th abnormal area is caused due to the reflected light of the sum light, and the processing proceeds to step S130. Whereas if there is the abnormal area, the control unit 48 judges that the j-th abnormal area is attributed to fire, and the processing proceeds to step S129.

In step S129, the control unit 48 instructs the display device interface 42 so that the display device 32 displays character information indicating occurrence of fire and a positional data of the fire, i.e., the positional data of the j-th abnormal location. Simultaneously, the control unit 48 instructs the storage device interface 46 to write the fact of the fire being happened and the positional data of the j-th abnormal location to the storage device 45. After the processes given above, the control unit 48 makes the processing proceed to step S130.

In step S130, the control unit 48 checks whether or not the variant j is equal to the variant k. Then, if the variant j is unequal to the variant k, the processing returns to step S113.

If the variant j is equalized to the variant k as a result of repeating the loop of steps S113 through S130 described above, the control unit 48 exits this loop at S130, and the processing proceeds to step S131.

In step S131, the control unit 48 checks whether or not the variant i is equal to a variant n. Then, if the variant i is unequal to the variant n, the processing returns to step S102 in order to execute the process on the image data given from the next one of the monitor infrared-ray cameras 33*l*–33*i*.

In contrast with this, when the processes on the image data given from all the monitor infrared-ray cameras 33*l*–33*i* have been completed, the variant i is equalized to the variant n. In this case, the control unit 48 finishes the fire monitoring program.

Note that the storage device 45 is stored with the sun reflection table containing a date and a time zone when the reflected light of the sun light falls upon each of the infrared-ray cameras for every small region in this embodiment. Instead of this, the azimuth and the angle of elevation for the sun at each abnormal location may be calculated.

Figure 14:
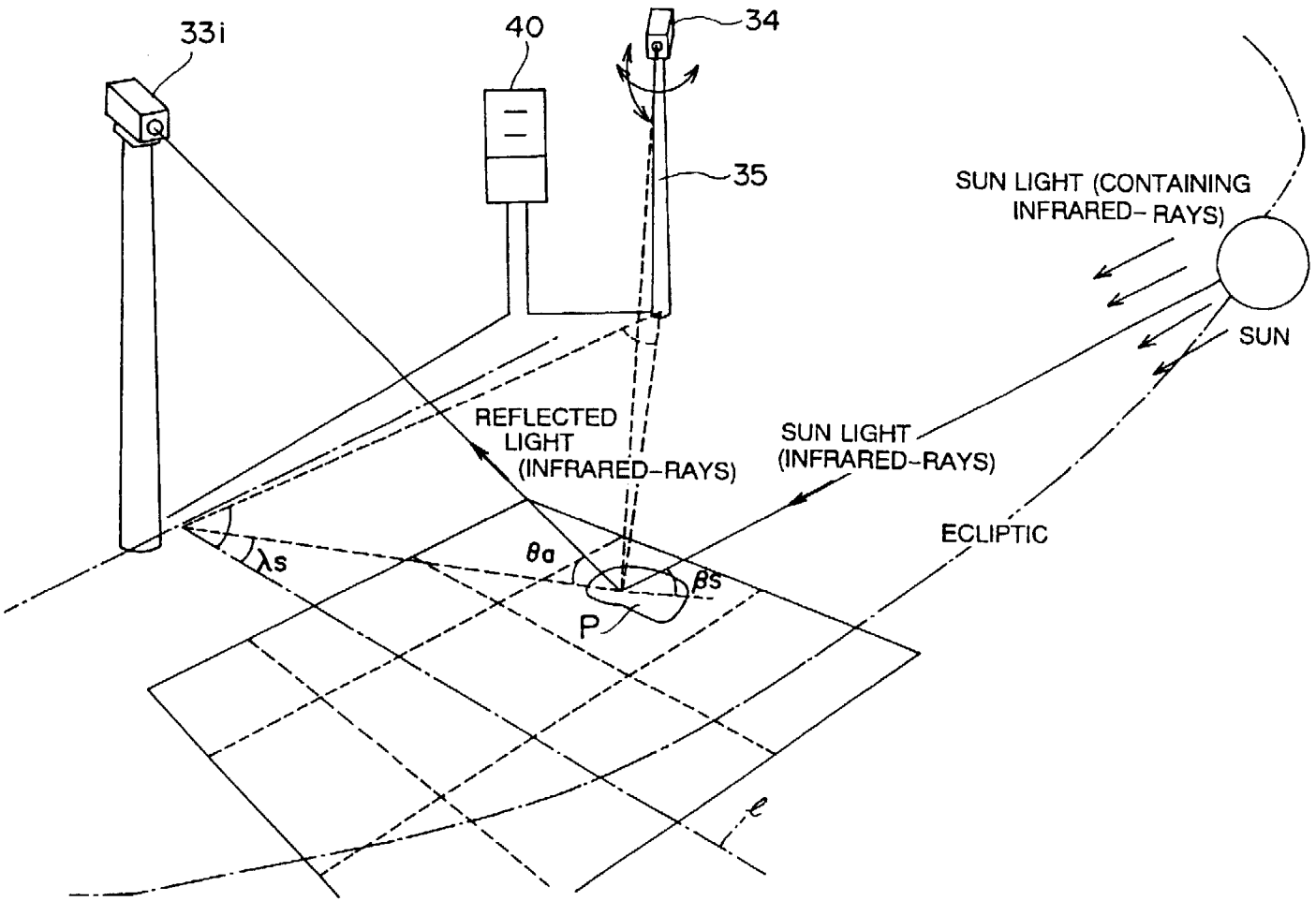
FIG. 14 is a conceptual view showing how the reflected light of the sun light is incident on the infrared-ray camera shown in FIG. 8.
Figure 15:
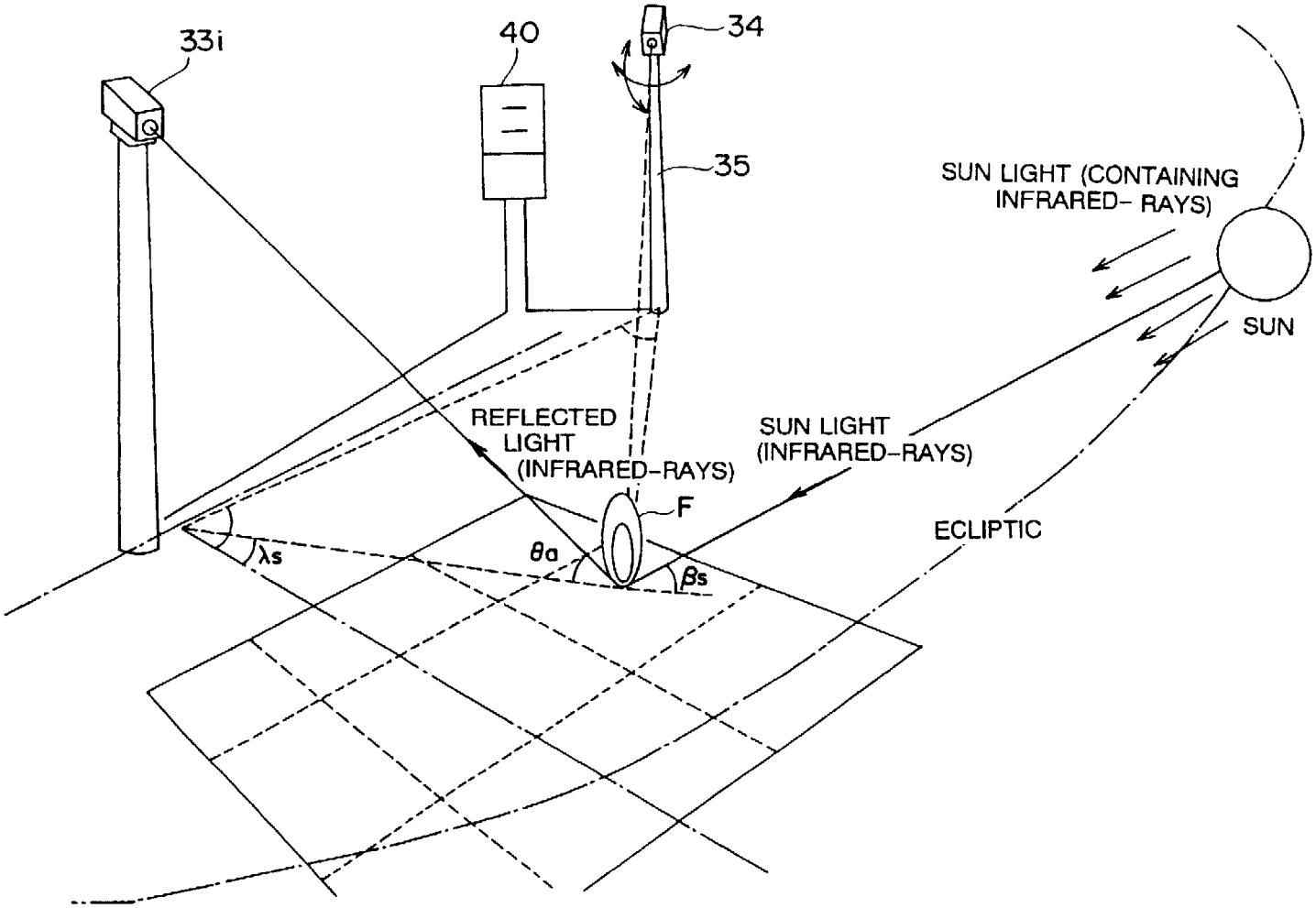
FIG. 15 is a conceptual view showing how the infrared-rays caused by the fire are incident upon the infrared-ray camera shown in FIG. 8.
Figure 16:
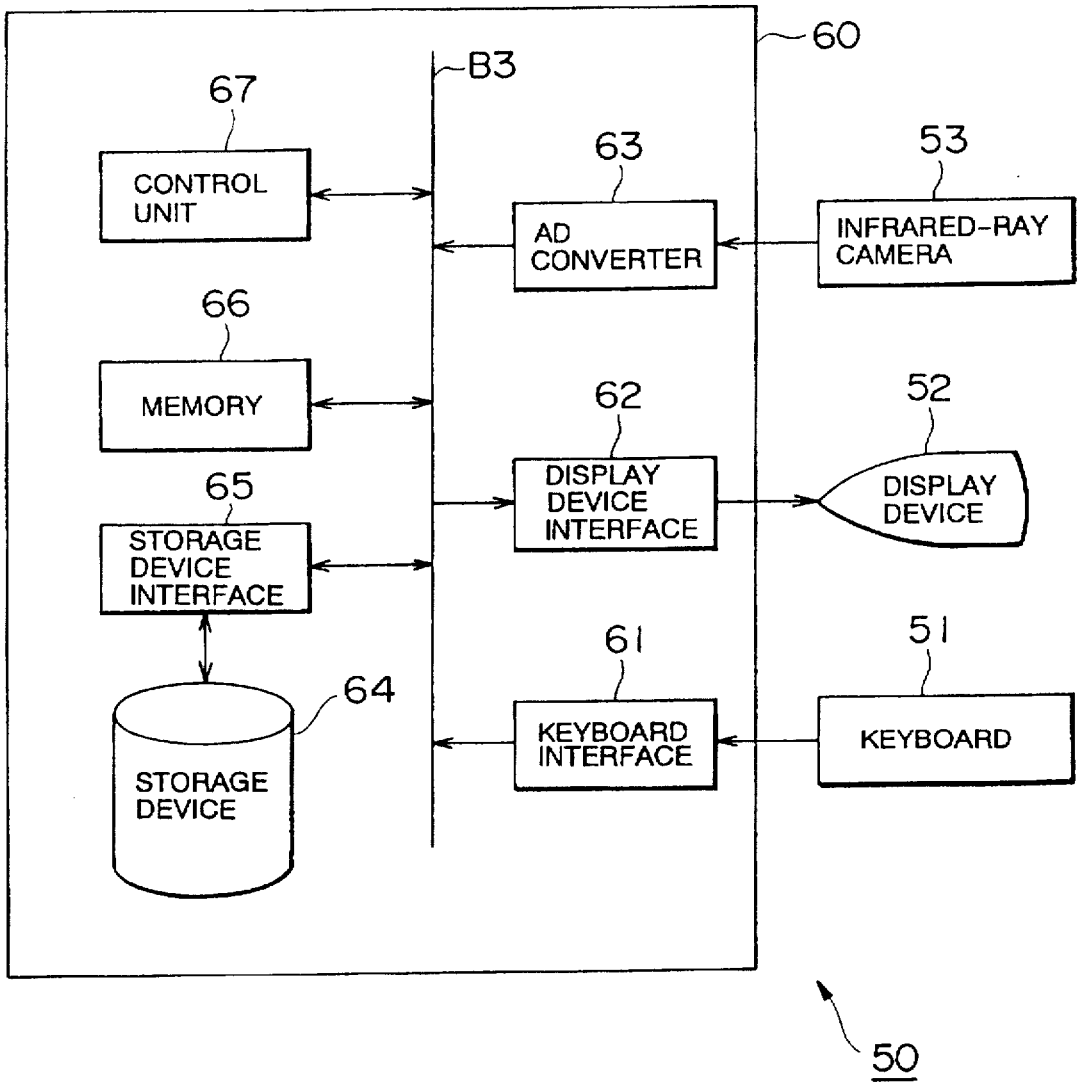
FIG. 16 is a block diagram showing a construction of a prior art fire monitoring apparatus.
Figure 17:
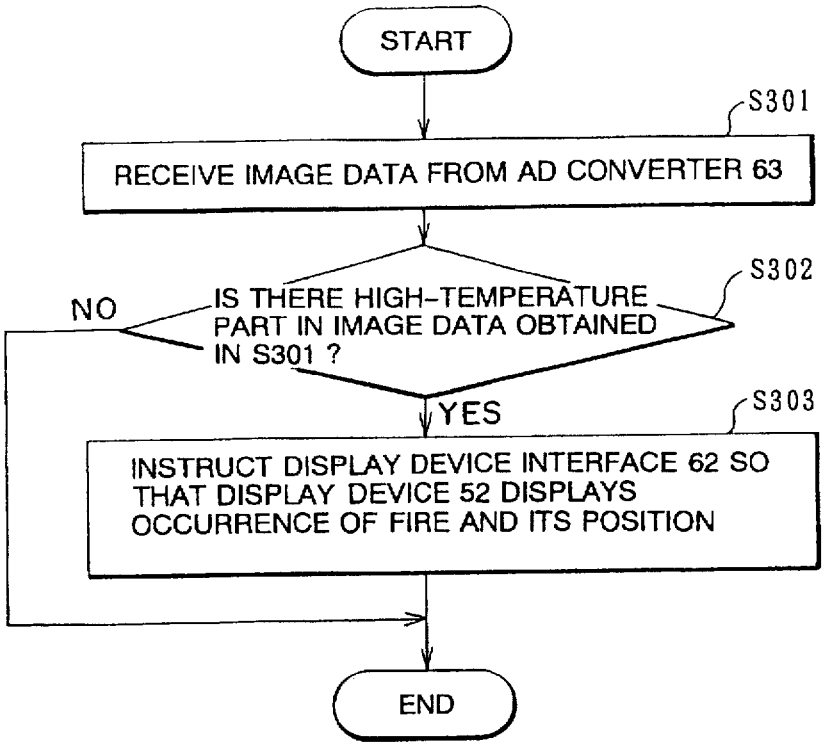
FIG. 17 is a flowchart showing a control process executed by a control unit shown in FIG. 16.

Next, the operation in this embodiment will be explained with reference to FIGS. 14 and 15. FIG. 14 shows an example where the puddle P exists within the monitoring target plane. Referring to FIG. 14, the sun light reflected by the puddle P is incident upon the i-th monitor infrared-ray camera 33*i*. In such a case, the prior art fire monitoring apparatus tends to judge that the fire occurs in the location where the puddle P exists. In accordance with this embodiment, the control unit 48 in the fire monitoring apparatus 30 detects an abnormal area in the image data given from the i-th monitor infrared-ray camera 33*i*. The control unit 48, however, retrieves the date and the time zone when the sun light reflected by the abnormal location corresponding to the abnormal area strikes on the i-th monitor infrared-ray camera 33*i*, and judges that there might be a possibility of the relevant abnormal area being caused due to the reflected light of the sun light. Next, the control unit 48 turns the turn table 35 so that the image field of the confirmation infrared-ray camera 34 includes the abnormal location. Thereupon, the abnormal location is photographed also by the confirmation infrared-ray camera 34 in addition to the i-th monitor infrared-ray camera 13*i*. In this case, the reflected light of the sun light is not incident upon the confirmation infrared-ray camera 34, and hence the control unit 48 does not detect the abnormal area in the image data given from the confirmation infrared-ray camera 34. Therefore, th control unit 48 of the fire monitoring apparatus 30 in this embodiment, even if the puddle P exists, never mis-recognizes that fire occurs. Further, FIG. 15 shows a case where the fire F happens within the monitoring target plane. Referring to FIG. 15, the infrared-rays caused by the fire F are incident on the i-th monitor infrared-ray camera 33*i*. In this case, the control unit 48 in the fire monitoring apparatus 30 detects an abnormal area in the image data given from the i-th monitor infrared-ray camera 33*i*. The control unit 48, however, retrieves the date and the time zone when the sun light reflected by the abnormal location corresponding to the abnormal area falls on the i-th monitor infrared-ray camera 33*i*, and judges that there might be a possibility of the abnormal area being caused due to the reflected light of the sun light. Next, the control unit 48 turns the turn table 35 so that the image field of the confirmation infrared-ray camera 34 embraces the abnormal location. Thereupon, the abnormal location is imaged also by the confirmation infrared-ray camera 34 in addition to the i-th monitor infrared-ray camera 13*i*. In this case, the infrared-rays caused by the fire F are incident upon the confirmation infrared-ray camera 34, and therefore the control unit 48 detects the abnormal area also in the image data given from the confirmation infrared-ray camera 34, thereby judging that the fire happens. Accordingly, the control unit 48 of the fire monitoring apparatus 30 in this embodiment does not mis-recognize that fire does not occur.

As discussed above, according to the present invention, despite the fact that no fire occurs, there is made such a mis-recognition that fire occurs due to the reflected light of the sun light being incident upon the infrared-ray camera. Further, if constructed so that the respective partial areas on the monitoring target plane are photographed by the plurality of infrared-ray cameras the photographing directions of which are different from each other, in spite of the fact that the fire actually occurs, there is made no such mis-recognition that the fire does not occur due to a misjudgment that the reflected light of the sun light is incident upon the infrared-ray camera.

What is claimed is:

1. A fire monitoring apparatus comprising:

an infrared-ray photographing device for photographing a monitoring target plane with infrared-rays;

detecting means for detecting an abnormal area exhibiting a temperature over a fixed temperature in an infrared-ray image photographed by said infrared-ray photographing device;

calculating means for calculating an azimuth and an angle of elevation toward the sun from an abnormal location on the monitoring target plane which corresponds to the abnormal area;

comparing means for comparing an azimuth toward the abnormal location from said infrared-ray photographing device with an azimuth toward the sun from the abnormal location, and for comparing an angle of depression toward the abnormal location from said infrared-ray photographing device with the angle of elevation toward the sun from the abnormal location; and judging means for judging that fire occurs if any one of these comparisons does not result in coincident.

2. A fire monitoring apparatus comprising:

a plurality of infrared-ray photographing devices arranged so that each area within a monitoring target plane is photographed with infrared-rays by at least two infrared-ray devices in different directions;

detecting means for detecting an abnormal area exhibiting a temperature over a fixed temperature in infrared-ray images photographed by each of said infrared-ray photographing devices;

calculating means for calculating an azimuth and an angle of elevation toward the sun from an abnormal location on the monitoring target plane which corresponds to the abnormal area; and comparing means for comparing an azimuth toward the abnormal location from said infrared-ray photographing device that photographs an infrared-ray image containing the abnormal area with an azimuth toward the sun from the abnormal location, and for comparing an angle of depression toward the abnormal location from said infrared-ray photographing device with the angle of elevation toward the sun from the abnormal location; and judging means for judging that fire occurs if any one of these comparisons does not result in coincident.

3. A fire monitoring apparatus comprising:

a plurality of fixed infrared-ray photographing devices for respectively photographing any one of partial areas on a monitoring target plane with infrared-rays;

a confirmation infrared-ray photographing device capable of photographing all areas on the monitoring target plane with infrared-rays by rotating a photographic optical axis thereof;

rotating means for rotating the photographic optical axis of said confirmation infrared-ray photographing device;

detecting means for detecting an abnormal area exhibiting a temperature over a fixed temperature in infrared-ray images photographed by said fixed infrared-ray photographing devices and an infrared-ray image photographed by said confirmation infrared-ray photographing device;

calculating means for calculating an azimuth and an angle of elevation toward the sun from an abnormal location on the monitoring target plane which corresponds to the abnormal area detected in the infrared-ray image photographed by any of said fixed infrared-ray photographing devices; and comparing means for comparing an azimuth toward the abnormal location from said fixed infrared-ray photographing device with an azimuth toward the sun from the abnormal location, and for comparing an angle of depression toward the abnormal location from said fixed infrared-ray photographing device with the angle of elevation toward the sun from the abnormal location; and control means for judging, if any one of these comparisons does not result in coincident, that fire occurs, or for instructing, if both of these comparison result in coincident, said rotating means to rotate said photographic optical axis of said confirmation infrared-ray photographing device so that an image field of said confirmation infrared-ray photographing device includes the abnormal location, and thereafter judging that the fire occurs in case an abnormal area corresponding to the abnormal location is contained in the infrared-ray image photographed by said confirmation infrared-ray photographing device.

4. A fire monitoring apparatus comprising:

an infrared-ray photographing device for photographing a monitoring target plane with infrared-rays;

detecting means for detecting an abnormal area exhibiting a temperature over a fixed temperature in an infrared-ray image photographed by said infrared-ray photographing device;

storing means for storing segmenting data for segmenting the monitoring target plane into small regions and univocally allocating numerals to the respective small regions, and a sun reflection table in which the numerals are made corresponding to a date and a time zone when an azimuth toward each small region from said infrared-ray photographing device is coincident with an azimuth toward the sun from the same small region and an angle of depression toward the same small region from said infrared-ray photographing device is coincident with an angle of elevation toward the sun from the small region for every small region; and controlling means for obtaining the numeral allocated to the small region which includes an abnormal location, corresponding to the abnormal area, on the monitoring target plane on the basis of the segmenting data, reading the date and the time zone made corresponding to that numeral from the sun reflection table, and judging that fire occurs if a data and a time when the infrared-ray image is photographed are not included in the date and the time zone read from the sun reflection table.

5. A fire monitoring apparatus comprising:

a plurality of fixed infrared-ray photographing devices for respectively photographing any one of partial areas on a monitoring target plane with infrared-rays;

a confirmation infrared-ray photographing device capable of photographing all areas on the monitoring target plane with infrared-rays by rotating a photographic optical axis thereof;

rotating means for rotating the photographic optical axis of said confirmation infrared-ray photographing device;

detecting means for detecting an abnormal area exhibiting a temperature over a fixed temperature in infrared-ray images photographed by said respective fixed infrared-ray photographing devices and an infrared-ray image photographed by said confirmation infrared-ray photographing device;

storing means for storing segmenting data for segmenting the monitoring target plane into small regions and univocally allocating numerals to the respective small regions, and a sun reflection table in which the numerals are made corresponding to a date and a time zone when an azimuth toward each small region from a fixed infrared-ray photographing device is coincident with an azimuth toward the sun from the same small region and an angle of depression toward the same small region from the same fixed infrared-ray photographing device is coincident with an angle of elevation toward the sun from the same small region for every small region; and controlling means for specifying the numeral allocated to the small region which includes an abnormal location on the monitoring target plane that corresponds to the abnormal area detected in the infrared-ray image photographed by any one of said fixed infrared-ray photographing devices on the basis-of the segmenting data, reading a date and a time zone made corresponding to the specified numeral from the sun reflection table, judging that fire occurs if a date and a time when those infrared-ray image is photographed are not included in the date and the time zone read from the sun reflection table, instructing said rotating means to rotate the photographic optical axis of said confirmation infrared-ray photographing device so that the small region is included in an image field of said confirmation infrared-ray photographing device if the date and the time when the infrared-ray image is photographed are included in the date and the time zone read from the sun reflection table, and judging that fire occurs if an abnormal area corresponding to the abnormal location is contained in the infrared-ray image photographed by said confirmation infrared-ray photographing device.

6. A computer readable medium recorded with a program of instructing a computer connected to an infrared-ray photographing device for photographing a monitoring target plane with infrared-rays, to execute processes of:

detecting an abnormal area exhibiting a temperature over a fixed temperature in an infrared-ray image photographed by said infrared-ray photographing device;

calculating an azimuth and an angle of elevation toward the sun from an abnormal location on the monitoring target plane which corresponds to the abnormal area;

comparing an azimuth toward the abnormal location from said infrared-ray photographing device with an azimuth toward the sun from the abnormal location;

comparing an angle of depression toward the abnormal location from said infrared-ray photographing device with the angle of elevation toward the sun from the abnormal location; and judging that fire occurs if any one of the comparisons does not result in coincident.

7. A computer readable medium recorded with a program of instructing a computer connected to a plurality of infrared-ray photographing devices arranged so that each area within a monitoring target plane is photographed with infrared-rays by at least infrared-ray photographing devices in different directions, to execute processes of:

detecting an abnormal area exhibiting a temperature over a fixed temperature in infrared-ray images photographed by said infrared-ray photographing devices;

calculating an azimuth and an angle of elevation toward the sun from an abnormal location on the monitoring target plane which corresponds to the abnormal area; and comparing an azimuth toward the abnormal location from said infrared-ray photographing device photographing infrared-ray image containing the abnormal area with an azimuth toward the sun from the abnormal location;

comparing an angle of depression toward the abnormal location from said infrared-ray photographing device with the angle of elevation toward the sun from the abnormal location; and judging that fire occurs if any one of the comparisons does not result in coincident.

8. A computer readable medium recorded with a program of instructing a computer connected to a plurality of fixed infrared-ray photographing devices for respectively photographing any one of partial areas on a monitoring target plane with infrared-rays, a confirmation infrared-ray photographing device capable of photographing the entire areas on the monitoring target plane with the infrared-rays by rotating a photographic optical axis thereof, and a rotating device for rotating the photographic optical axis of said confirmation infrared-ray photographing device, to execute processes of:

detecting an abnormal area exhibiting a temperature over a fixed temperature in infrared-ray images photographed by said fixed type infrared-ray photographing devices and an infrared-ray image photographed by said confirmation infrared-ray photographing device;

calculating an azimuth and an angle of elevation toward the sun from an abnormal location on the monitoring target plane which corresponds to the abnormal area detected in the infrared-ray image photographed by any of said fixed infrared-ray photographing devices;

comparing an azimuth toward the abnormal location from said fixed infrared-ray photographing device with an azimuth toward the sun from the abnormal location;

comparing an angle of depression toward the abnormal location from said fixed infrared-ray photographing device with the angle of elevation toward the sun from the abnormal location;

judging that fire occurs if any one of the comparisons does not result in coincident;

instructing said rotating device to rotate said photographic optical axis of said confirmation infrared-ray photographing device so that an image field of said confirmation infrared-ray photographing device includes the abnormal location, if both of those comparison is coincident, and thereafter judging that fire occurs in case an abnormal area corresponding to the abnormal location is contained in the infrared-ray image photographed by said confirmation infrared-ray photographing device.

9. A computer readable medium recorded with a program of instructing a computer connected to an infrared-ray photographing devices for photographing a monitoring target plane, and comprising a storage device which stores segmenting data for segmenting the monitoring target plane into small regions and for univocally allocating numerals to the respective small regions and a sun reflection table in which the numerals are made corresponding to a date and a time zone when an azimuth toward each small region from said infrared-ray photographing devices is coincident with an azimuth toward the sun from this small region and an angle of depression toward the same small region from said infrared-ray photographing device is coincident with an angle of elevation toward the sun from the small region for every small region, to execute processes of:

detecting an abnormal area exhibiting a temperature over a fixed temperature in an infrared-ray image photographed by said infrared-ray photographing device;

specifying the numeral allocated to a small region which includes an abnormal location on the monitoring target plane that corresponds to the abnormal area on the basis of the segmenting data;

reading a date and a time zone made corresponding to the specified numeral from the sun reflection table; and judging that fire occurs if the date and the time when the infrared-ray image is photographed are not included in the date and the time zone read from the sun reflection table.

10. A computer readable medium recorded with a program of instructing a computer connected to a plurality of fixed infrared-ray photographing devices for respectively photographing any one of partial areas on a monitoring target plane with infrared-rays, a confirmation infrared-ray photographing device capable of photographing the entire areas on the monitoring target plane with the infrared-rays by rotating a photographic optical axis thereof, and a rotating device for rotating the photographic optical axis of said confirmation infrared-ray photographing device, and comprising a storage device which stores segmenting data for segmenting the monitoring target plane into small regions and for univocally allocating numerals to the respective small regions and a sun reflection table in which the numerals are made corresponding to a date and a time zone when an azimuth toward each small region from a fixed infrared-ray photographing devices is coincident with an azimuth toward the sun from the same small region and an angle of depression toward the same small region from the same fixed infrared-ray photographing device is coincident with an angle of elevation toward the sun from the same small region for every small region, to execute processes of:

detecting an abnormal area exhibiting a temperature over a fixed temperature in infrared-ray images photographed by said respective fixed infrared-ray photographing devices and an infrared-ray image photographed by said confirmation infrared-ray photographing device;

specifying the numeral allocated to a small region which includes an abnormal location on the monitoring target plane that corresponds to the abnormal area detected in the infrared-ray image photographed by any one of said fixed infrared-ray photographing device on the basis of the segmenting data;

reading a date and a time zone made corresponding to the specified numeral from the sun reflection table;

judging that fire occurs if the date and the time when the infrared-ray images are photographed are not included in the date and the time zone read from the sun reflection table;

instructing, if the date and the time when the infrared-ray images are photographed are included in the date and the time zone read from the sun reflection table, said rotating device so that the small region is embraced into an image field of said confirmation infrared-ray photographing device, and judging that fire occurs if an abnormal area corresponding to the abnormal location is contained in the infrared-ray image photographed by said confirmation infrared-ray photographing device.

* * * * *